United States Patent [19]

Gelzer

[11] Patent Number: 4,757,895

[45] **Date of Patent: * Jul. 19, 1988**

[54] ARTICLE PACKAGING SYSTEM

[76] Inventor: John R. Gelzer, 2211 Lane Rd., Columbus, Ohio 43220

[ * ] Notice: The portion of the term of this patent subsequent to Apr. 22, 2003 has been disclaimed.

[21] Appl. No.: 855,176

[22] Filed: Apr. 22, 1986

Related U.S. Application Data

[63] Continuation-in-part of Ser. No. 652,579, Sep. 20, 1984, Pat. No. 4,583,641.

[51] Int. Cl.[4] ..... B65D 73/02

[52] U.S. Cl. ..... 206/330; 206/328; 206/479

[58] Field of Search ..... 206/328, 330, 345, 346, 206/347, 485, 479; 361/380, 398, 419, 420

[56] References Cited

U.S. PATENT DOCUMENTS

| | | | |
|---|---|---|---|
| 3,523,608 | 5/1969 | Miller | 206/330 |
| 3,823,818 | 7/1974 | Shaw | 206/479 |
| 4,523,702 | 6/1985 | Viio | 206/479 |
| 4,583,641 | 4/1986 | Gelzer | 206/329 |
| 4,621,486 | 11/1986 | Slavicek | 206/345 |
| 4,631,897 | 12/1986 | Slavicek | 206/330 |
| 4,633,370 | 12/1986 | Hamuro et al. | 206/330 |

*Primary Examiner*—David T. Fidei

*Attorney, Agent, or Firm*—Robert E. Stebens

[57] ABSTRACT

An article packaging system is provided which includes elongated, flat strip form carrier and bonding tapes that are releasably mechanically interconnected together at longitudinally spaced points to package articles therewith between adjacent points of interconnection of the tapes. An interference-type of mechanical interconnection is provided with either or both the carrier and bonding tapes formed from resiliently flexible strips of material with portions of one or both flexed in effecting assembly or disassembly.

16 Claims, 11 Drawing Sheets

ARTICLE PACKAGING SYSTEM

This application is a continuation-in-part of application Ser. No. 652,579 filed Sept. 20, 1984 and copending at the time of filing, now U.S. Pat. No. 4,583,641.

FIELD OF THE INVENTION

This invention relates in general to article packaging and relates more specifically to packaging for relatively small sized articles such as electrical components or mechanical components. It relates more specifically to a packaging system that enables automation of production systems utilizing such components in that it facilitates automated dispensing of the components at a work or use station as well as facilitating interim handling functions of those components. The invention relates in particular to an article packaging system that includes a carrier tape on which the articles to be stored, transported and dispensed are positioned in predetermined relationship to the carrier tape and are retained in association therewith by bonding means in the form of an elongated tape that is looped over the articles and is releasably secured to the carrier tape by mechanical interconnection.

BACKGROUND OF THE INVENTION

Articles of manufacture, and particularly those of electronic circuit type, incorporate many diverse subcomponents which are inserted into other components or subassemblies or are interconnected by various means into electrical circuit systems. These electrical components upon fabrication require handling in the form of storage, transportation and ultimate dispensing at the use or work station where they are incorporated in the apparatus. Electrical components such as solid-state devices invariably have connecting electrodes which frequently are in the form of relatively short wires or pins or narrow electrical strips that have little structural strength and are readily subject to distortion and bending. These electrical contacts or electrodes are frequently designed to be disposed in predetermined relationship with respect to other electrodes in multiple groups common to solid-state integrated circuit devices so as to interfit into a circuit board socket or other type of connecting device for effecting electrical interconnection, but those electrodes may not necessarily have any fixed dimensional relationship to the physical structure of the body portion of the component. Examples of such electrical components are the integrated circuit devices, capacitors and electrical coils as well as numerous types of connectors and other components, either mechanical or electrical. Utilization of these components makes it essential that they be applied to the major circuit component or subassembly such that the electrodes form an electrical circuit with the circuit system of the component or subassembly. Because of the relatively fragile nature of these electrodes, handling of the components either in storage or interim testing functions and even at the ultimate use or work station may cause bending of one or more of the electrodes such that it is not precisely aligned or oriented with respect to the other electrodes. When this occurs, then the component is difficult to install and very frequently will be inadvertently installed such that there will be less than a complete electrical interconnection, thereby resulting in a defective assembly which may or may not be repairable. In those cases where the defective assembly is repairable, the repair will obviously necessitate further expense and time to place it in a usable condition and consequent increased production cost. If not repairable, then the entire assembly may, of necessity, require complete scrapping and thus result in increased production cost.

There are known attempts to package electrical components in a manner which will eliminate or substantially reduce the problem with respect to damage to electrical contacts or electrodes and to facilitate handling. These attempts have been partially induced to enable automation of systems for the dispensing of the components at work or use stations in their application to system assemblies. An example of such a system is the packaging of components such as the cylindrical rod-type electrical resistors or flat, disc shaped capacitors on elongated flexible tapes. Components such as these resistors are provided with two relatively long electrical leads which are oriented with respect to the component to extend in axially aligned but opposite directions. A number of such components are arranged in a series with their leads disposed in spaced parallel relationship. The terminal end portions of each of the two leads are secured to respective elongated strips of tape which, with the components, form a package. In utilization of components packaged in this manner, a component is gripped by its leads by a machine at the assembly station and the leads are cut to the desired length with the marginal end portions and tape being discarded. If necessary for a particular assembly, the leads remaining with the component may be bent or formed to specific configuration for assembly. Orientation of the lead is not a problem since the item is gripped by its leads and is thus in a proper orientation. While these tape systems have been found useful in automating assembly operations, these paper tape systems are limited in usefulness to items such as or similar to the resistor or capacitor elements which do not exhibit the problems of orientation and alignment of their electrode leads as is associated with the integrated circuit chips that are designed to be installed in printed circuit boards.

Automation in manufacturing has received initial motivation as a consequence of direct labor costs involved in the heretofore conventional assembly line type operations. While that labor cost remains significant, there are other factors that contribute to the total cost of a manufacturing or assembly operation. These other factors are packaging, storage and transport of the components, subcomponents, or even subassemblies, prior to their utilization at an assembly station. In many instances, there is a requirement for additional handling between the components' initial fabrication and packaging and ultimate utilization such as testing of components for functional operation. Failure to perform such testing prior to assembly with other components will result in defective products which results in inceased production costs regardless of whether a defective unit may be repairable. There is a further important factor in effecting automation of a manufacturing system and that is the inventory and scheduling of the components to an assembly station in coordination with other components to that same assembly line or operation. Economics of automation require computer control of a complete manufacturing system and component packaging thus plays an extremely important role in achieving the objectives of enabling components to be efficiently handled throughout an entire automated manufacturing system. The economics of the manufacturing process dictate that packaging of the components, or subassemblies, must be capable of automatic machine handling at all stages. Loading of components into a package, package storing and transport and delivery or dispensing of the components must be capable of being accomplished without manual operations to enable computer controlled operations that are now an economic necessity.

SUMMARY OF THE INVENTION

In accordance with this invention, an article packaging system is provided that is capable of accepting the articles such as electrical components with electrodes and to provide protection for those components subsequent to their fabrication in the course of storage, handling and in their utilization in a total manufacturing system susceptible to automated computer control. In addition to relatively simple configured components such as electrical resistors having only two leads, the packaging system of this invention is capable of handling components having a large number of electrodes and complex configurations such as the now widely used solid-state devices. The packaging system provided by this invention in an illustrative embodiment comprises an elongated carrier tape formed from a flat strip of material that is flexible to enable a length of the tape on which components are packaged to be wound or coiled for purposes of storage or to enable the carrier tape to be routed through a dispensing mechanism. Retention of the articles on the carrier tape at predetermined locations with a plurality of the articles being disposed in serially spaced relationship on the elongated carrier tape is effected by bonding means which, in the illustrative embodiment, also comprises an elongated flexible tape of strip form. The bonding tape and carrier tape are formed with cooperative means that effects a mechanical interlock to releasably secure the bonding tape at predetermined intervals to the carrier tape with loops of the bonding tape extending in overlying relationship to the respective articles for protectively encapsulating and maintaining the articles in their predetermined positions on the carrier tape.

Positioning of the articles on the carrier tape at predetermined locations is effected by article locating means that is formed with or in the carrier tape or attached to the tape. The locating means may take the form of apertures that are dimensioned and configured to receive the pin or wire type electrodes of the components or other elements designed to cooperatively engage with a component or article in effecting the desired orientation. In order that the carrier tape will also function at a dispensing station in delivery of the components at a precise point with respect to the electrodes, the carrier tape is advantageously formed with indexing means that cooperate with the mechanism performing the actual dispensing function or which may perform other functions with respect to the components. This indexing may, for example, be in the form of perforations formed along marginal edge portions of the carrier tape to interengage with pins or cogs on sprocket wheels or other index means of the dispensing mechanism and thereby effect orientation with the perforations being oriented in a predetermined relationship to the article locating means. With this arrangement, the carrier tape is enabled to deliver an article at a fixed location with the electrical leads being oriented in a precise determined relationship to that location regardless of the particular physical configuration and dimensional relationship of the component's body to those electrodes. This capability is extremely important where the assembly is effected by automated mechanisms such as computer controlled robotic devices.

Disclosed in application Ser. No. 652,579 is a packaging system embodying the basic invention comprising a carrier tape and a bonding tape that are constructed to form a releasable mechanical interlock when assembled and retain the articles that are to be thereby packaged. The mechanical interconnection of the two tapes specifically disclosed in that application comprised an aperture formed in the carrier tape at each point of interconnection with the bonding tape and a respective loop of the bonding tape projected through each aperture. The apertures formed in each of the illustrative embodiments were of a transverse dimension with respect to the longitudinal axis of the carrier that was at least equal to and not less than the width of the carrier tape projected through the aperture. Mechanical interlocking of the carrier and bonding tapes specifically illustrated in that application was effected by cooperative notches formed in the transverse sides of the apertures in the carrier tape and in the longitudinal side edges of the bonding tape. An alternative and essentially inverse configuration also specifically disclosed in that application comprised a projection formed on each transverse side of an aperture formed in the carrier tape and apertures or sockets formed in the bonding tape to receive those projections. Projection of a loop of the bonding tape is effected with relative ease as by the insertion tool that was also shown as the bonding tape loop would be compressed to a dimension that would pass through the most narrow dimension of the aperture whether the transverse sides of the aperture were provided with notches or the projections. This constructional configuration of the mechanical interlock elements is particularly advantageous because of the relative ease of assembly. A minimal force is required to be applied to a loop of the bonding tape to project the loop into the aperture of the carrier tape since the loop is merely compressed to a dimension where it will pass through the aperture until it is at a proper position to interlock and it then expands to place the respective components in interlocked relationship. While that specific type of mechanical interlock is also advantageous at the time of dispensing in that the bonding tape may be separated from the carrier with relative ease, there is the attendant disadvantage of the tapes inadvertently becoming unlocked.

To minimize the likelihood of inadvertent unlocking, a modified mechanical interlock is provided by this invention for an article packaging system of this type comprising a carrier tape and a bonding tape in its basic structure. In accordance with one aspect of this invention, the carrier tape is formed with apertures that have spaced parallel, transversely extending edges and the bonding tape is formed with notches along its longitudinal edges that will mechanically interlock with the carrier tape upon projection of a loop of the bonding tape into a respective carrier tape aperture at the transversely spaced end edges of the aperture. Assembly, or disassembly is accomplished by temporary bending or deforming of the bonding tape in the vicinity of the notches to an extent that the bonding tape will pass through an aperture. Assembly or disassembly of the tapes requires application of sufficient force to effect deformation of the bonding tape with the force required being proportionally related to the stiffness of the bonding tape which is formed from a resiliently flexible strip of material. While assembly requires application of the requisite force to effect deformation or bending, this construction achieves the advantageous objective of minimizing the likelihood of inadvertent unlocking of the tapes.

A second advantageous objective achieved by constructing the tapes in accordance with this invention is that it provides the option of either forming the loop of the bonding tape projecting through the carrier tape to be of a relatively large configuration or of a relatively flat configuration. The large loop configuration performs the desirable function of protecting the leads or connector pins of an electrical component that also project through the carrier tape. A flat loop configuration is advantageous where the packaged article either has none or relatively short elements that project through the carrier tape as the space or volume requirements such as when spiral winding of the packaging system onto a storage or dispensing reel are minimized. In those instances where necessary, protection for short projections or leads can be conveniently provided by means of a barrier strip disposed adjacent the underside of the carrier tape without a significant increase in the overall bulk of the package.

The constructional configuration of the mechanical interlock embodying this invention may also be formed in a relatively inverted relationship. In an inverted construction, the bonding tape is formed without notches in its side edges whereas the apertures in the carrier tape are formed with notches. Forming a pair of notches in the transversely spaced end edges of the aperture that extend longitudinally of the carrier tape results in formation of an element that is susceptible to deformation and to similarly effect a mechanical interlock.

A modification of the packaging system of this invention includes a third elongated tape in combination with the carrier and bonding tapes to perform a spacing function. In this combination, a plurality of apertures are formed in the carrier tape in transversely aligned relationship at each point of interconnection of the bonding tape and the spacer tape with the carrier tape. The bonding tape is projected through its respective apertures to effect the desired mechanical interlock. The spacer tape which is also formed from a resiliently flexible strip of material with notches along its longitudinal edges is projected through its respective notches from the opposite side of the carrier tape to effect a mechanical interlock. By appropriately longitudinally spacing the notches at respective points of interconnection along the spacer tapes, loops of a desired size can be provided in overlying relationship to the location of a packaged article and thereby provide protection for any leads or other elements of the article that project through the carrier tape.

Another modification of the packaging system of this invention also includes an additional elongated tape in combination with the carrier and bonding tapes to perform a locating function for the articles. In this combination, the locating tape is constructed similarly to the bonding tape and is mechanically interconnected with the carrier tape by projection of a loop through the same aperture through which a loop of the bonding tape will also be projected. The bonding tape thus lies superposed over the locating tape and performs its function of retaining the articles. The locating tape has apertures formed therein to receive the articles and provide lateral support for the articles and better assure that the articles will be properly oriented with respect to the carrier tape at the time of dispensing. A modified packaging system may be constructed to include both a locating tape and a spacer tape.

A further modification of the packaging system of this invention incorporates another relatively inverted relationship of the elements forming the mechanical interlock. In this modification, the bonding tape is formed with a plurality of projections along each longitudinal edge. These projections are formed at longitudinally spaced intervals and extend a distance laterally outward with respect to the bonding tape to also extend beyond the transversely spaced end edges of the apertures in the carrier tape. Projecting of a loop of the bonding tape including a pair of oppositely extending projections through an aperture by temporarily deforming the projections such as by bending effects assembly of the two tapes into mechanically interlocked relationship.

In the specific illustrative embodiments of the invention, the carrier tape and bonding tape are formed with respective attachment means and connecting means adapted to releasably mechanically interengage for the purpose of retaining articles in association with the assembled tapes. Additionally, the tapes are formed from a material exhibiting resilient characteristics such that the tapes may be assembled into mechanically interlocked relationship and function to maintain the mechanically coupled engagement, but readily permit detachment at the dispensing station where the components are to be removed for utilization.

A further feature of the specific illustrative embodiment is the capability of the bonding tape to perform a protective function in addition to the retaining function. Not only does the bonding tape retain the articles in association with the carrier tape, but it protects those components as to their body portion by effectively encapsulating the articles in cooperation with the carrier tape.

The article packaging system of this invention is of particular utility because of its unique ability to enhance the storage, transport and utilization of the components that are so packaged and adaptability to machine automated, computer controlled operations at all stages. The carrier and bonding tape when assembled in mechanically interlocked relationship constitute a primary package formed from flexible strips of material readily adapted to spiral coiling in a secondary packaging device. A suitable secondary packaging device is disclosed in application Ser. No. 652,579, but other secondary packaging may be utilized such as an ordinary reel having a central arbor and spaced side walls defining an annular chamber into which a length of the primary package may be wound in a spirally coiled configuration.

These and other objects and advantages of the invention will be readily apparent from the following detailed description of illustrative embodiments of the invention and the accompanying drawings thereof.

DESCRIPTION OF THE DRAWING FIGURES

DESCRIPTION OF THE ILLUSTRATIVE EMBODIMENT

Figure 1:
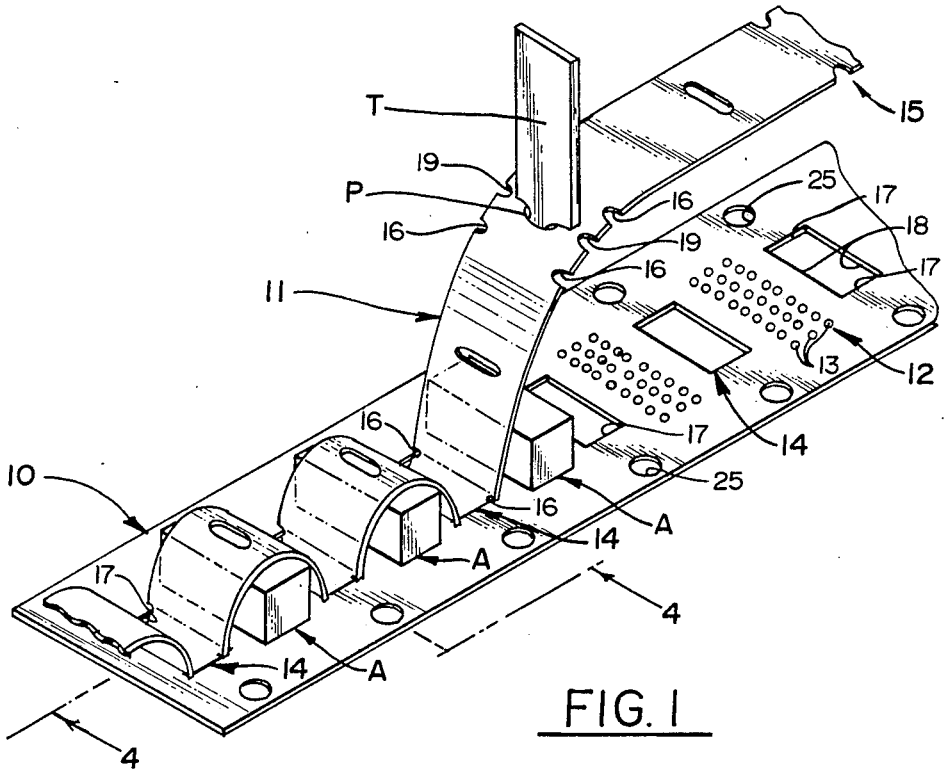
FIG. 1 is a perspective view of a fragmentary portion of a packaging system embodying this invention and including a carrier tape and a bonding tape partially assembled with components.
Figure 4:
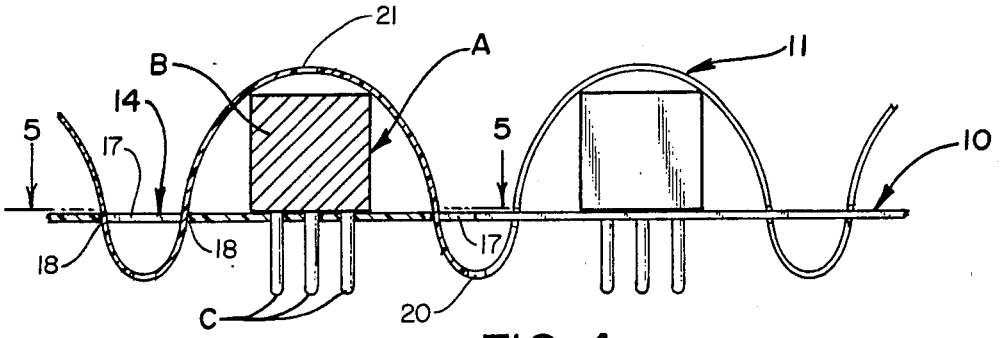
FIG. 4 is a fragmentary sectional view on an enlarged scale taken along line 4—4 of FIG. 1.

Referring to FIG. 1, an article packaging system embodying this invention is shown in fragmentary perspective view with portions of the respective elements thereof shown separate prior to assembly into packaging relationship with a series of articles which are designated by the letter A. These articles are diagrammatic representations of components such as electrial components, but without reference to any specific dimension or component configuration. These compnents are representative of articles that may be packaged by the packaging systems provided in accordance with this invention and the components depicted as exemplary are typical solid-state devices. Thus, each of the articles A is merely represented as comprising a component body B of rectangularly shaped, block-form configuration and provided with a plurality of electrically conductive connector pins or electrodes C which can be seen in other figures of the drawings such as FIG. 4. Furthermore, for purposes of example, the articles may be provided with a number of the connector pins C arranged in a plurality of rows arranged in parallel relationship and extending parallel to the long dimension of the illustrative component. While the subsequent description of this specific embodiment of the article packaging system is described with reference to an article of this particular configuration and construction, it is to be understood that this description is for purposes of example and that the packaging system may be adapted to function with articles of different configuration and also for purpose of packaging articles other than electrical system components.

The illustrative basic embodiment of the article packaging system includes only two components and these are described as a carrier tape 10 and article bonding means in the form of an article bonding tape 11. The carrier tape 10 is formed from a flat strip of material that is relatively thin and which exhibits a requisite degree of flexibility to permit its functioning in the intended manner for packaging in a spirally coiled manner on reels (not shown) and feeding through various types of mechanisms, particularly automated dispensing mechanisms. It is advantageous to use materials for forming of the carrier tape that are either sufficiently low in cost as to economically permit disposal once the packaging system has performed its function or which can be recycled should it be deemed uneconomical to reuse in forming of further packaging. In the exemplary embodiment, the carrier tape is formed from a suitable synthetic resin or plastic material which in the illustrative configuration will provide adequate structural strength for support of the components and mechanical interengagement with the bonding tape as well as cooperative functioning with various utilization or handling mechanisms or machines.

Figure 2:
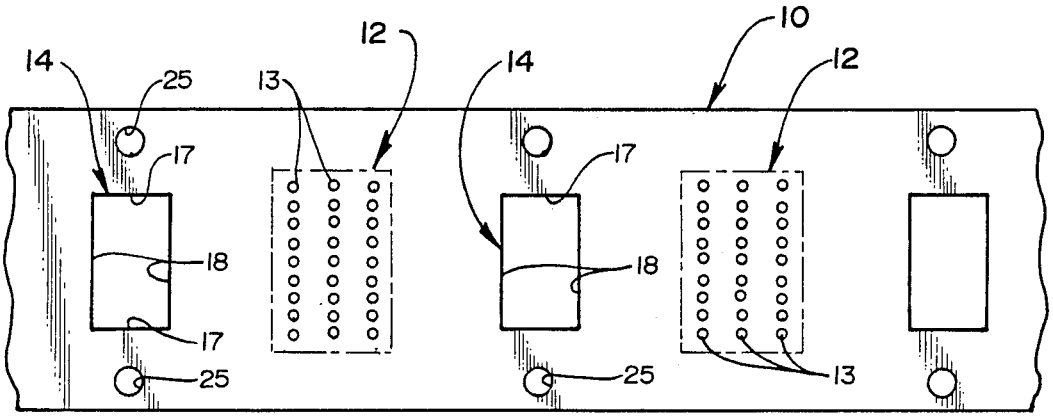
FIG. 2 is a plan view of a fragmentary portion of the carrier tape on an enlarged scale.

To perform the function of positioning the articles on the carrier tape 10 at a predetermined location, the tape is formed with longitudinally spaced article locating means 12 which, in the illustrative embodiment, comprise a plurality of apertures 13 that are dimensioned and relatively disposed to receive the connector pins of the article A with those pins thus projecting through the carrier tape. If desired, the carrier tape 10 may be designed wth a plurality of the apertures 13 as shown in FIG. 2 in a predetermined grid pattern such that the tape will be adaptable to a number of such articles, although each of the different types of articles may have different arrangements and numbers of the connector pins. Also, forming a grid-type pattern of the apertures 13 enables any particular article to be located at a desired relative position with respect to both the longitudinal axis of the carrier tape and its transverse axis. It will also be understood that the specific article locating means 12 shown is for purpose of illustration of an exemplary locating means which may be modified in accordance with the requirements for a particular article destined to be packaged in an article packaging system embodying this invention. Modifications thereof are illustrated in the drawings and are described in application Ser. No. 652,579.

The article bonding tape 11 is also advantageously formed from a low cost material such as a synthetic resin or plastic to economically permit disposal, but it can be formed from a material which is adapted to be recycled. In the illustrative embodiment, the bonding tape is formed from a plastic material and comprises an elongated strip of the material which is relatively thin to more readily permit its flexing, thereby enabling interengagement with the carrier tape 10 and conforming to the body B of the articles in effecting retention of the articles on the carrier tape. The width of the bonding tape 11 is determined in part by the particular article A which is to be packaged and, to more fully enable performance of the protective function, is of a width which can be equal to or greater than the dimension of the article in transverse relationship to the carrier.

It will be understood that the widths of the carrier tape 10 and bonding tape 11 are determined in the first instance by the articles which are to be packaged. However, it is contemplated that the packaging system will be fabricated in several standardized width sizes that are accommodated by the various automated machines or mechanisms with which the system may be utilized. By way of example, the carrier tape may be provided in 1, 2, 3, 4, and 6 inch widths in development of modular type systems. It is to be understood that these dimensions are for purpose of illustration and other modular dimensioning may be employed as well as even greater widths of the carrier tape.

Figure 3:
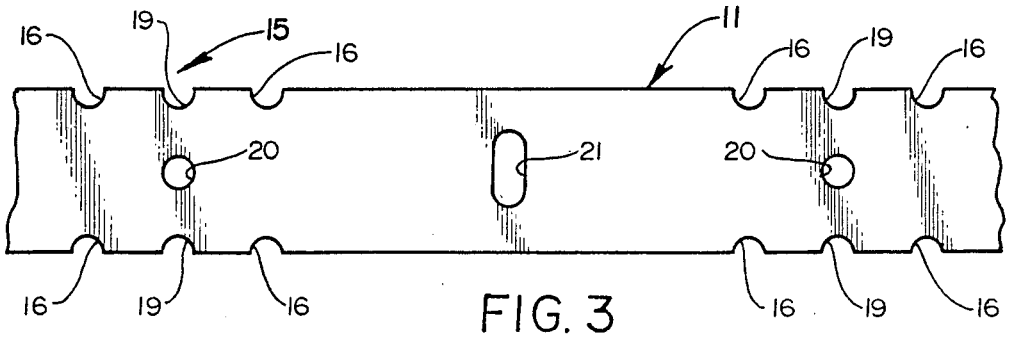
FIG. 3 is a plan view of a fragmentary portion of the bonding tape on an enlarged scale.

Releasable interengagement of the bonding tape 11 with the carrier tape 10 in the FIG. 1 embodiment is effected by mechanical interengaging means including cooperating attachment means 14 formed in the carrier tape and connecting means 15 formed with the bonding tape. Attachment means 14 comprises an aperture formed in the carrier tape and of predetermined configuration which will mechanically couple with the connecting means 15 which comprises sets of notches 16 formed in marginal edge portions of the bonding tape as can be best seen in FIGS. 2 and 3 which are plan views of the carrier and bonding tapes, respectively. The apertures 14 are formed intermediate each article locating means 12 at the approximate midpoint therebetween and in longitudinally aligned relationship to the locating means along a central longitudinal axis of the tape.

Figure 5:
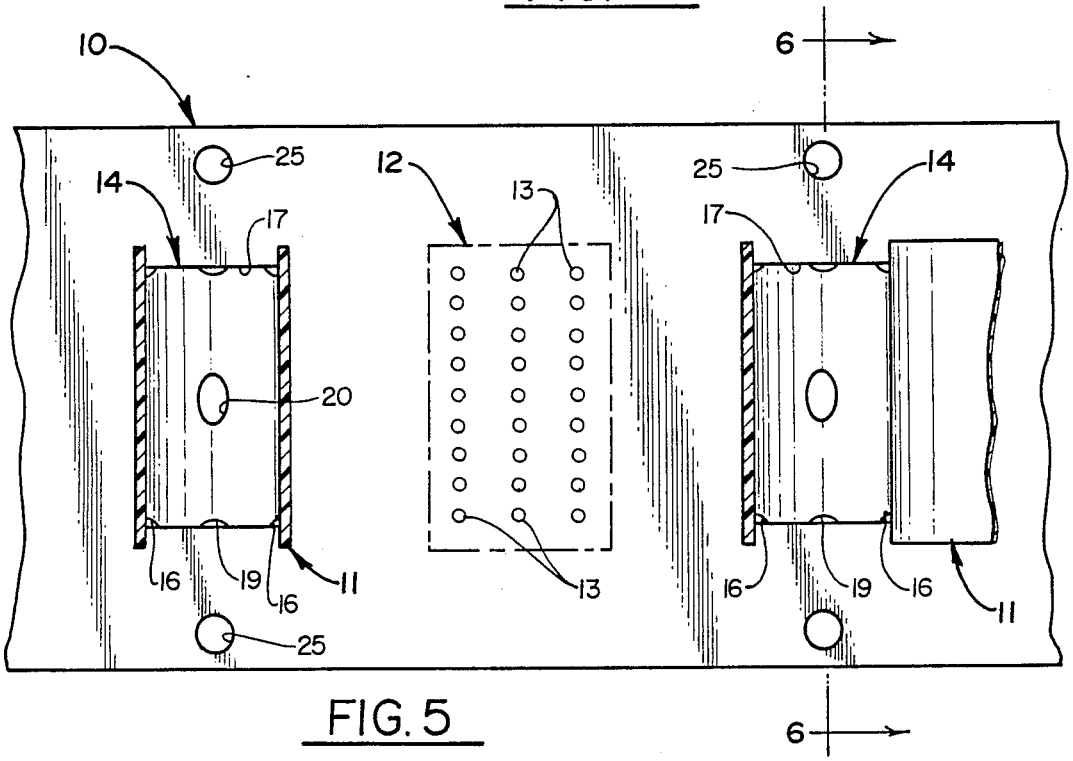
FIG. 5 is a fragmentary sectional view on an enlarged scale taken along line 5—5 of FIG. 4.
Figure 6:
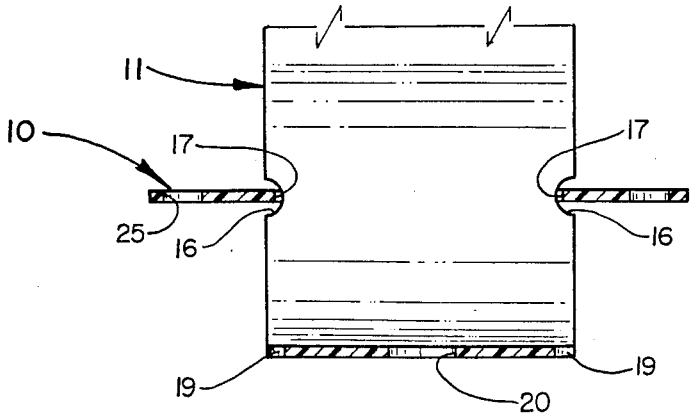
FIG. 6 is a sectional view taken along line 6—6 of FIG. 5.
Figure 7:
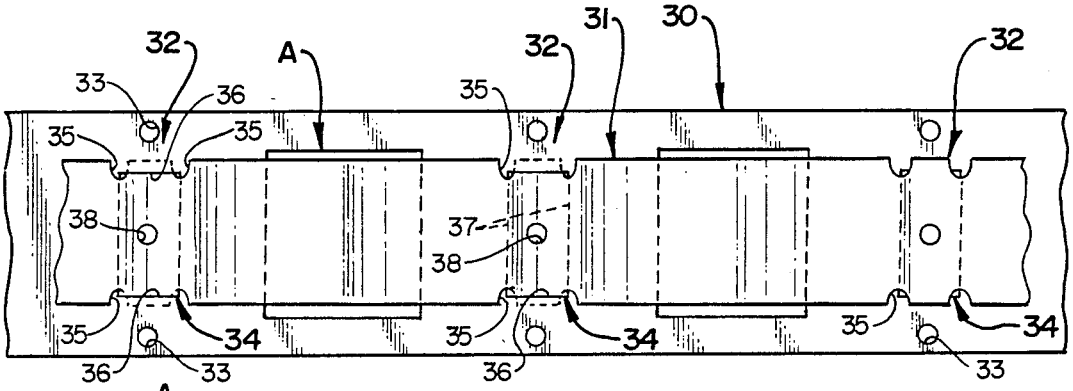
FIG. 7 is a top plan view of a fragmentary portion of a modified packaging system embodying this invention.

Each of the apertures 14 is of generally rectangular configuration having transversely spaced, end edges 17 interconnected by transversely extending edges 18. Pairs of notches 16 are formed in the longitudinal marginal edge portion of the bonding tape in opposed relationship with four of these notches forming a connecting means 15. Each notch is of a size to receive the carrier tape in edgewise relationship as can be best seen in FIGS. 5 and 6. Also as can be best seen in FIGS. 5 and 6, the bonding tape has a transverse dimension that is greater than the transverse spacing of the aperture's end edges 17, but the transverse dimension between the innermost ends of opposed pairs of notches 16 is slightly less. Thus, with the two tapes assembled as illustrated, they are mechanically interlocked at each point of attachment. This configuration of the attachment and connecting means 14, 15 provides a mechanical interlock which is effected by folding the bonding tape 11 into a loop centered on the notches 16 and projecting that loop through the attachment means aperture 14 in a manner as can be best seen in FIGS. 4 and 6. With the bonding tape 11 projected into the aperture 14, its resilience will tend to cause adjacent portions of the loop to diverge and displace those portions into contacting engagement with the transverse side edges 18 of the aperture in the carrier tape. As will be subsequently explained in further detail, the loop formed in the bonding tape is forcibly projected into the aperture 14 with an accompanying bending or flexing of the marginal edge portions of the tape between the notches 16. Once the loop is inserted, those marginal edge portions return to their original position and thereby effect mechanical interlocking of the tapes. When thus interlocked, the likelihood of inadvertent disassembly of the tapes is minimized because of the necessity to apply a sufficient force to effect flexing if the marginal edge portion of the bonding tape between the notches 16.

Retention of the articles A in their respective article locating means 12 is effected by the length of the bonding tape 11 which extends over those articles from between the two points of interconnection with the carrier tape as by the attachment and connecting means 14, 15. Thus, by appropriately spacing the sets of notches 16 forming the connecting means 15, it is possible to cause the intervening length of the bonding tape 11 to extend in relatively close conformity to exterior surface portions or points on the articles A. For a specific article having particular dimensions, it is therefore possible to configure the bonding tape so that it will contactingly engage with respective articles and secure the articles to the carrier tape. Design of a carrier tape and bonding tape is thus determined in part by the dimensions of the articles A such that the carrier tape 10 may be provided with the article locating means and the attachment apertures 14 whereby an appropriately dimensioned and constructed bonding tape 11 may be utilized for any specific article.

Assembly of the tapes requires formation of a loop in the bonding tape 11. Formation of this loop is facilitated by weakening the bonding tape in the region of the sharpest bend through formation of an additional pair of notches 19 in the opposite longitudinal edges of the tape at the midpoint between the notches 16. Further weakening is effected by forming of a circular aperture centrally located between the notches 19; however, the aperture 20 is formed to also facilitate the assembly of the tapes as will be subsequently explained. The effective resilience of the bonding tape 11 may be modified in other regions by forming of apertures, or for that matter, notches, at those locations where it is desired to reduce the resilient force. An illustrated example in the embodiment of FIGS. 1–6 is the formation of an elongated slot 21 extending transversely across the tape at substantially the midpoint between two adjacent points of attachment. This will result in the bonding tape assuming a more flat configuration across the top of the article A.

Assembly of the bonding tape 11 with the carrier tape 10 can be accomplished by relatively simple technique. Articles A will first be placed on the carrier tape with their respective connector pins inserted into the article locating means 12 and thus fixed in position on the surface of the carrier tape. Once this has been accomplished, the bonding tape 11 may then be applied in a sequential manner by looping the tape over the articles and then subsequently forming the interlocking loop and inserting that loop through an aperture 14. While this assembly may be relatively difficult if attempted only by means of manually attempting to fold and loop the tape, assembly is made relatively simple when an insertion tool is utilized. By way of example, an insertion tool T is illustrated in FIG. 1 and is seen as comprising a flat rigid plate which is formed with an axially projecting pin P at its lower end. For purposes of illustration, the insertion tool T may be held in a person's hand and the pin P then inserted into a circular aperture 20 formed in the bonding tape 11. This circular aperture 20 is formed centrally between the longitudinal edges of the tape and symmetrically located between the notches 19 as can be best seen in FIG. 3. Thus, with a simple downward projection of the insertion tool in substantial vertical alignment with the aperture 14, the tool will be effective to concurrently form an interconnecting loop in the bonding tape as well as causing the adjacent portion of the tape at one side to form into overlying relationship to that adjacent article A. The tool is of a width such that it may also pass through the aperture in projecting the formed loop into the aperture to a position where the notches 16 receive the carrier tape in edgewise relationship and then become interlocked with the carrier tape. As the loop of the bonding tape 10 is projected into the aperture 14, the marginal edge portions of the bonding tape between notch 19 and each notch 16 will be bent, folded or otherwise deformed at each side of the bonding tape so as to permit passage of the loop into the aperture. Where the loop has been projected through the aperture to a point where the notches 16 become aligned with the carrier tape, the marginal edge portions of the bonding tape between the notch 19 and each notch 16 will return to their original configuration, but now the carrier tape is received in the notches 16 in mechanically interlocked relationship. Disassembly of the bonding tape from the carrier tape can be effected by the simple expedient of pulling the bonding tape in a reverse relationship to itself such that it will be removed from interlocking relationship with the carrier tape through a reverse bending of the marginal edge portions of the bonding tape between the notches 16 and 19. It is to be understood that to effect either assembly or disassembly of the tapes, it will be necessary to support or restrain the carrier tape in a manner sufficient to resist the forces developed in assembly or disassembly operations. This described and illustrated technique of assembling the bonding tape 11 with the carrier tape 10 is deemed exemplary. It is contemplated that other apparatus incorporated in automated machines may also be provided to effect assembly of the tapes and packaging of articles.

In dimensionally configuring the bonding tape 11, it is advantageous to form the notches 16 in each respective pair of notches a distance apart sufficient to result in the formation of an interlocking loop that will project a predetermined distance outwardly from the opposite or underside of the carrier tape 10. Preferably, this interlocking loop will have a projecting depth which is greater than that of the connector pins C. As a consequence, the interlocking loops of the bonding tape will provide protection to those connector pins C as against their contact with other structures or components which could cause deformation of the pins. In effect, the interlocking loops form a support base for the packaging system.

To further enhance the usefulness and capabilities of the article packaging system embodying this invention, it is advantageous to provide the system with an indexing means. To provide positive control over its operation, such indexing means is conveniently provided through formation of a series of longitudinally spaced indexing apertures 25 which, if desired, may be formed along each marginal edge of the carrier tape 10. These indexing apertures 25 are designed to interfit or to interengage with pins or cogs on sprocket wheels or other devices of either the mechanisms for assembly of the packaging system with articles or the dispensing of those articles from the packaging or any other mechanism operating with the packaging system. These indexing apertures 25 are located in the carrier tape such that they will be oriented in specific dimensional relationship to the article locating means 12. In the FIG. 1–6 embodiment, these indexing apertures are shown disposed in transverse alignment with respective apertures 14 into which loops of the bonding tape are projected. While the indexing apertures 25 could be formed at other locations, such as in alignment with locating means 12, it is advantageous to locate the indexing apertures in alignment with the apertures 14. One advantage is that more than two indexing apertures may be formed in transversely aligned relationship across the carrier tape. This is of particular importance with respect to packaging systems of the modification such as that shown in FIGS. 14–18A. With the wider tape modifications, it is desirable to have more than two sprocket wheels to obtain better support and restraint of the carrier tapes during any of the operations associated with either assembly of the packaging system or disassembly and dispensing of the articles. Thus, it is possible through such indexing apertures to either precisely locate the carrier tape 10 at an article loading station or precisely locate the carrier tape at an article dispensing station. With the indexing apertures 25 located in predetermined relationship with respect to the article locating means 12, there is assurance that other mechanisms will be capable of positioning the articles in the locating means or to remove them from that position for subsequent use in automated systems. In using the tape indexing means in conjunction with the loading of the articles, it will be noted that the carrier tape 10 may thus be positively fixed during those sequential operations wherein an apparatus may mechanically load components onto the carrier tape and an insertion tool T which may be incorporated in a mechanical device can automatically perform assembly of the bonding and carrier tapes. Although indexing apertures 25 are illustrated, it will be understood that other indexing means and apparatus may be utilized.

The embodiment of the primary package illustrated in FIGS. 1–6 and previously described in detail is of a symmetrical construction and shown as functioning with uniformly sized artices. As such, the carrier tape 10 is formed with uniformly spaced attachment apertures 14 that function for attaching of the bonding tape 11 and having locating means 12 that are also uniformly spaced and disposed intermediate adjacent pairs of the attachment apertures for location of the articles A. Similarly, the bonding tape 11 is formed with its notches 16 that form the connecting means 15 disposed in uniformly spaced relationship and at the spacing necessary for accommodating a particular sized article in addition to forming a loop that projects a desired distance from the one side of the carrier tape to perform the spacing function. Accordingly, for a different sized article than that which is illustrated in FIG. 1, it may be necessary to provide a bonding tape wherein the notches 16 are at a greater or lesser spacing than that which is illustrated. The difference in spacing will be dictated by the particular size of the article such that the bonding tape will be effective in performing its bonding function and securely hold the article on the carrier tape. Depending upon the size of the articles A with which the carrier tape is to function, it may also be necessary to modify the spacing of the locating means 12 for those articles as well as modifying the distance or spacing for the attachment apertures 14. Such modifications in the spacing of the attachment apertures, as well as the locating means 12, may also necessitate a correlated modification in the spacing of the notches 16 formed in the bonding tape. It will also be understood that the width of the carrier tape 10 and bonding tape 11 is also determined by the size of the articles A with which it is to function. It is contemplated that the carrier tape 10 and bonding tape will be fabricated in a number of standard sizes as to width as previously described such that they will collectively accommodate a wide range of articles with which such a packaging system will function. Also, since the bonding tape 11 functions to provide protection for the articles, it is advantageously of a width that is comparable to the dimension of the articles A in a transverse direction relative to the carrier tape. The dimension of the article in a transverse direction to the carrier tape for convenience is referred to as being the articles' transverse dimension. However, the width of the bonding tape may be relatively larger than the transvserse dimension of the articles or, in cases where protection is not an essential criteria, that tape may be of a lesser width than the transverse dimension of the articles.

An article packaging system constructed in accordance with this invention also need not be limited to a single longitudinal row of articles as is illustrated in the embodiment shown in FIG. 1. It is possible to construct the packaging system such that a plurality of longitudinal rows of the articles may be positioned on a carrier tape. This modification is not illustrated as it is shown in application Ser. No. 652,579.

The illustrative embodiment described with reference to FIGS. 1–6 of the drawings employs a construction that produces a loop of the bonding tape that is of a relatively large extent from projecting a sufficient distance from the carrier tape to perform a protective function. This large loop construction is that which is shown in the drawings of application Ser. No. 652,579 and is of advantage not only in providing of protection for electrical component leads that extend a distance from the bottom surface of the carrier tape, but is beneficial in effecting the mechanical interlocking of the tapes of the specific construction illustrated in that application's drawings. However, with the interference type of mechanical interlock utilized with the several embodiments that are herein disclosed, the large loop may be dispensed with in those situations where its protective function is not necessary in favor of what is termed a "flat loop". The substantial elimination of a loop projecting from the underside of the carrier tape is made possible since the mechanical interlocking does not rely upon a diverging of adjacent elements or legs of the loop to effect mechanical interengagement of the bonding tape with the carrier tape.

An illustration of a basic flat loop packaging system embodying this invention is shown in FIGS. 7–10. This embodiment comprises an elongated carrier tape 30 and an elongated bonding tape 31 that are adapted to be mechanically interlocked together at longitudinally spaced attachment points 32 to secure articles A to the carrier tape. These articles A are also advantageously located at predetermined positions on the carrier tape by appropriate locating means (not shown) which may be of the construction shown in FIGS. 1–6 or shown in application Ser. No. 652,579 or any other suitable construction. Carrier tape indexing means in the form of index apertures 33 may also be provided. Attachment means in the form of rectangular apertures 34 are formed in the carrier tape in longitudinally spaced relationship and substantially in intermediate centered relationship between the location of the articles A and aligned with the index apertures 33. Connecting means 35 comprising pairs of notches 35 are formed in each of the longitudinal marginal edge portions of the bonding tape 31. As is the case with the FIGS. 1–6 embodiment, the apertures 34 have transversely spaced end edges 36 that are spaced apart a distance that is substantially equal to the transverse distance between the innermost ends of respective pairs of notches 35. Transverse side edges 37 interconnect with the end edges 36 of the apertures 33 and the bonding tape 31 may contact those edges when assembled with the carrier tape depending upon the spacing of the side edges and relative spacing of the pairs of notches 35. The relative spacing of the notches 35 in the flat loop embodiment is reduced to the minimum that is necessary to permit projection of the loop so that the marginal edge portions of the bonding tape extending between the notches 36 may be deformed, bent or flexed to a sufficient extent to pass through an aperture 34 and return to an unflexed configuration so as to effect mechanical interconnection. Assembly of the two tapes 30 and 31 into assembled relationship is effected in substantially the same manner as previously described by forcing the edge portions of the bonding tape 31 between an adjacent pair of notches 35 through the respective aperture 34 as a result of deforming or flexing the marginal edge portions of the bonding tape. Minimization of the size of the loop is accomplished through coordination of the spacing of the notches 35 and the relative difference between the transverse width of the bonding tape 31 and the transverse spacing between the innermost ends of the notches 35. A circular aperture 38 is formed in the bonding tape 31 in centered relationship to the sets of notches 35 for engagement with the pin P of an insertion tool T. Disassembly of the tapes may be effected by forcibly pulling the bonding tape out of an aperture in the manner described in conjunction with the FIG. 1–6 embodiment or a tool similar to that of the insertion tool T may be used by inserting the pin P into the aperture 38 from the bottom and pushing inwardly.

While the flat loop configuration effects a reduction in space requirements, it does not provide any significant protection for any leads or connector pins C of the article A that may project through the carrier tape.

Figure 8:
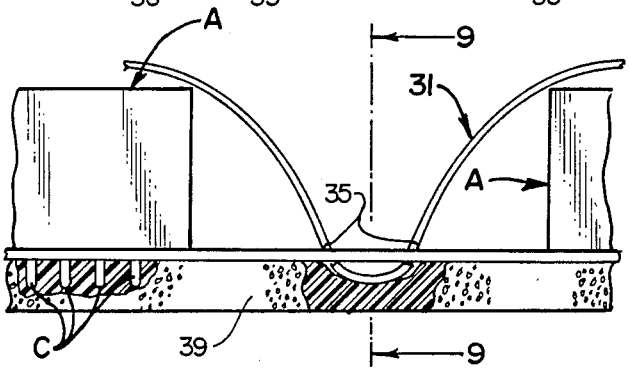
FIG. 8 is a side elevational view on an enlarged scale of a portion of the packaging system shown in FIG. 7.
Figure 9:
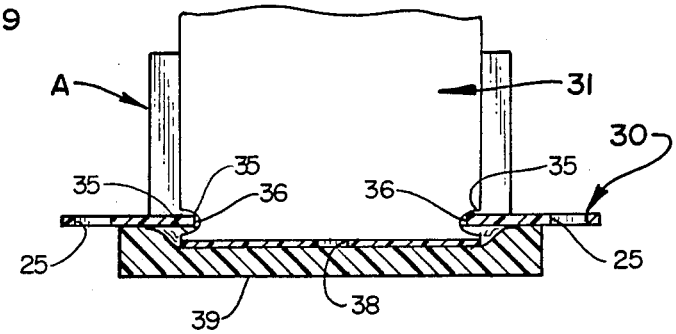
FIG. 9 is a sectional view taken along line 9—9 of FIG. 8.
Figure 10:
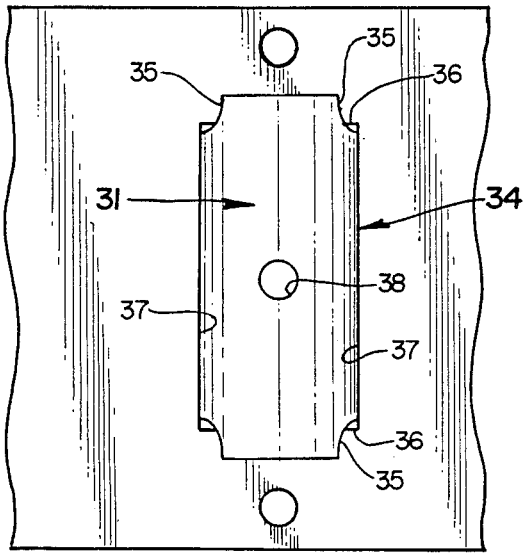
FIG. 10 is a bottom plan view on an enlarged scale of the packaging system shown in FIGS. 7-9, but with the barrier tape omitted.

Adequate protection for those leads can be readily provided by means of a barrier tape 39 placed adjacent the carrier tape 30 in superposed relationship as shown in FIGS. 8 and 9. A suitable barrier tape can be formed from an open celled plastic having sufficient strength to resist the compressive forces encountered in coiling of the packaging system onto a reel, but in most cases, will permit penetration of the leads or connector pins C. In those cases where the connector pins C of the articles A are extremely fragile and cannot be projected into an open-celled barrier tape, the barrier tape can be performed with a recess (not shown) into which the pins may extend.

Figure 11:
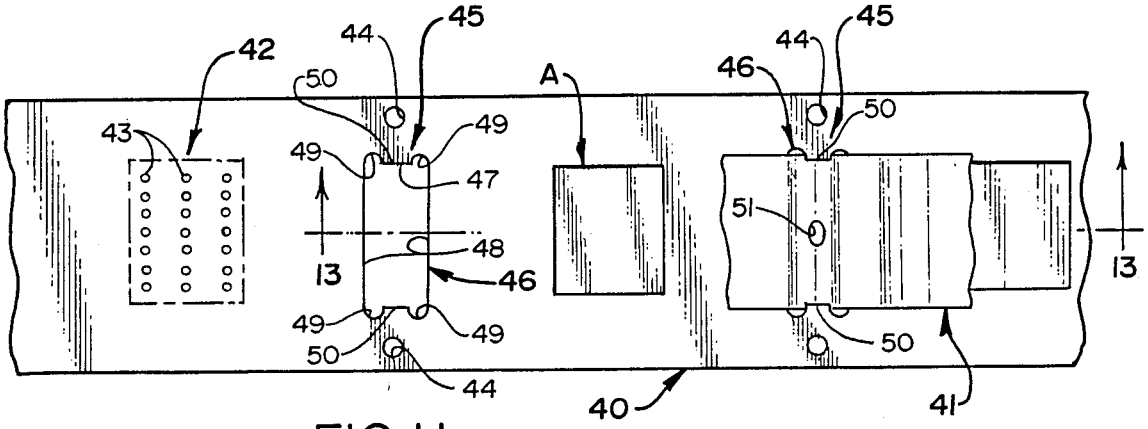
FIG. 11 is a top plan view of a fragmentary portion of another modified packaging system embodying this invention.
Figure 12:
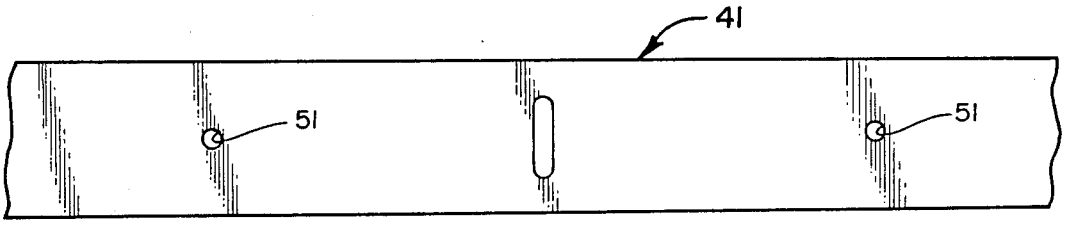
FIG. 12 is a plan view of a fragmentary portion of the bonding tape of the packaging system of FIG. 11.
Figure 13:
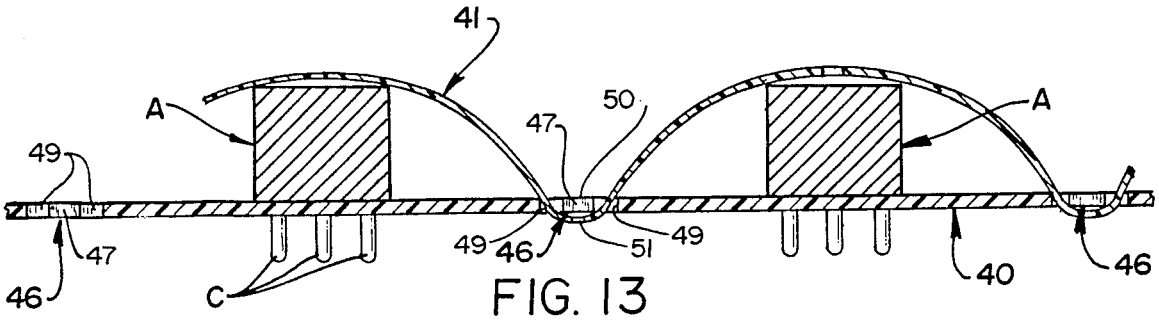
FIG. 13 is a sectional view on an enlarged scale taken along line 13—13 of FIG. 11.
Figure 14:
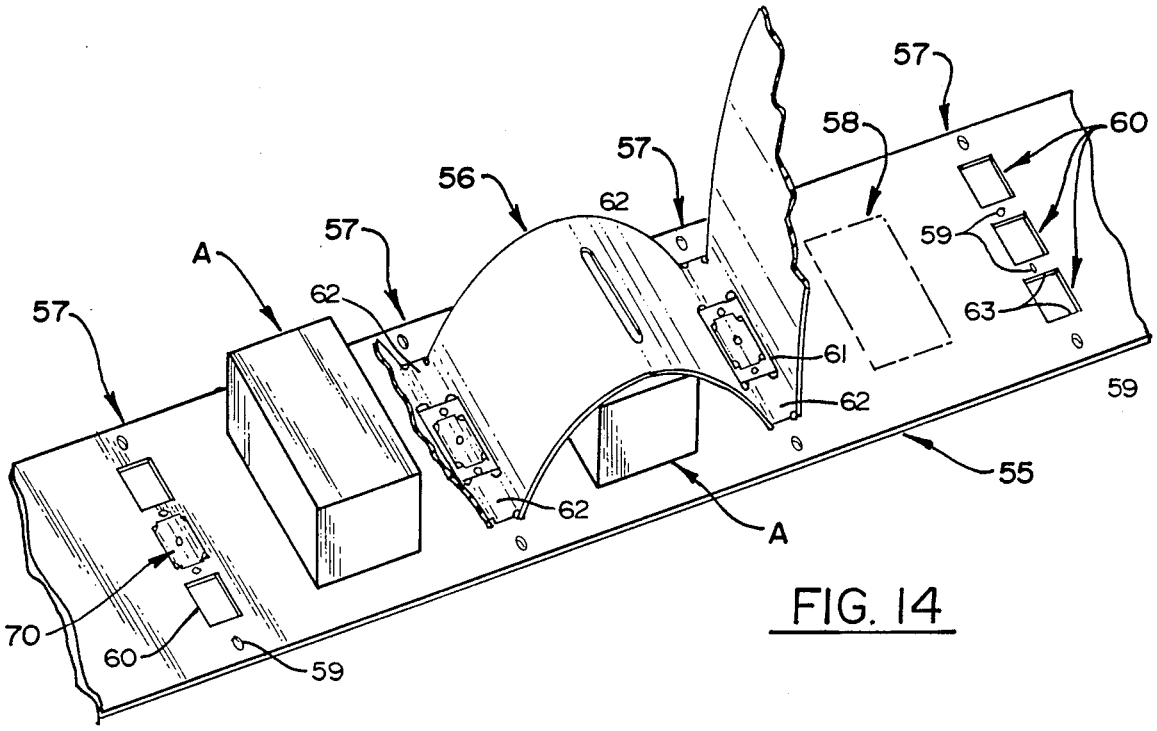
FIG. 14 is a perspective view of a fragmentary portion of another modified packaging system embodying this invention.
Figure 15:
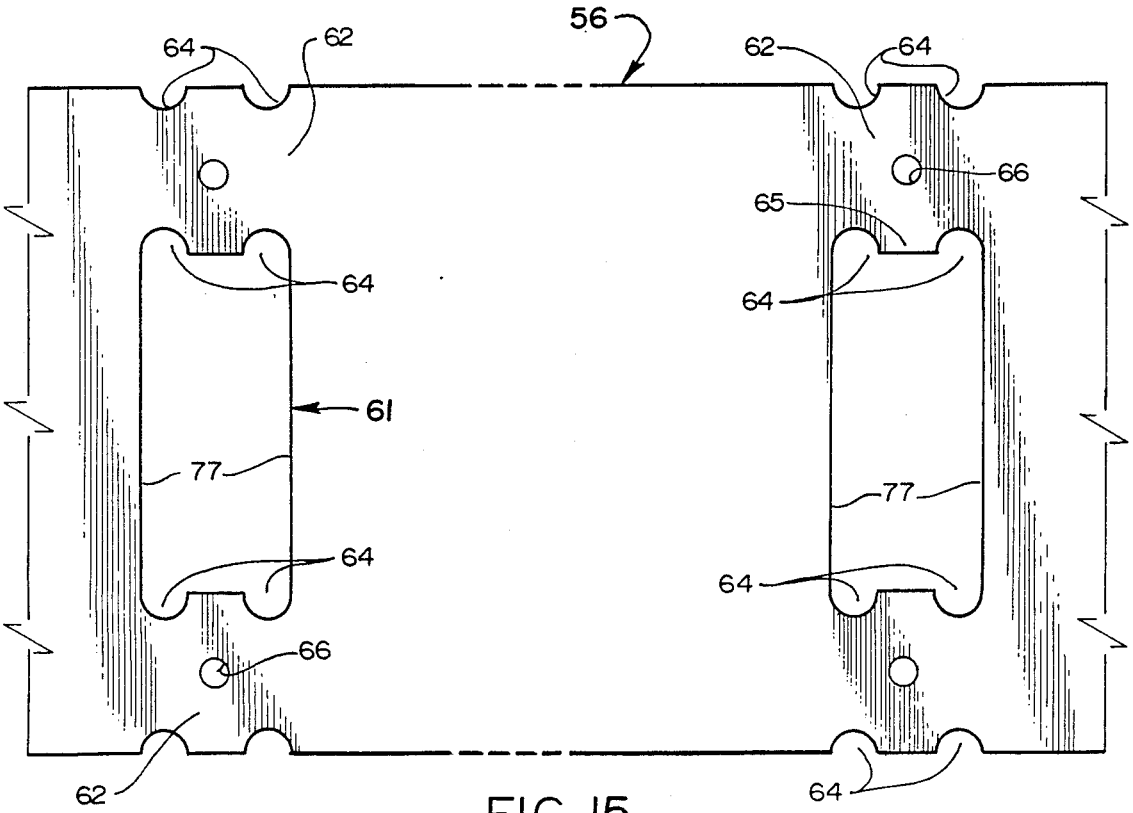
FIG. 15 is a fragmentary plan view on an enlarged scale of the carrier tape shown in FIG. 14.
Figure 16:
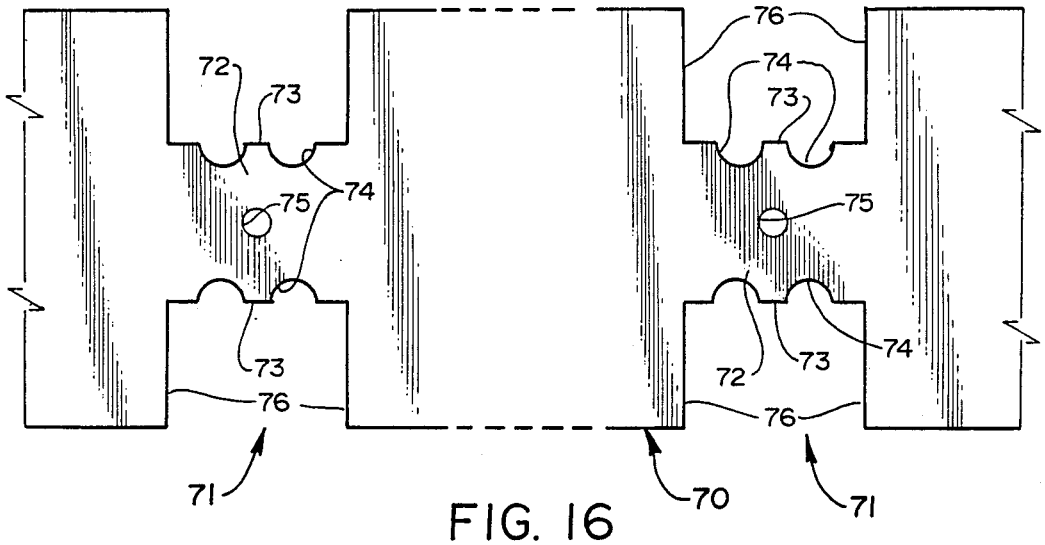
FIG. 16 is a plan view on an enlarged scale of the spacer tape included in the packaging system shown in FIG. 14.
Figure 17:
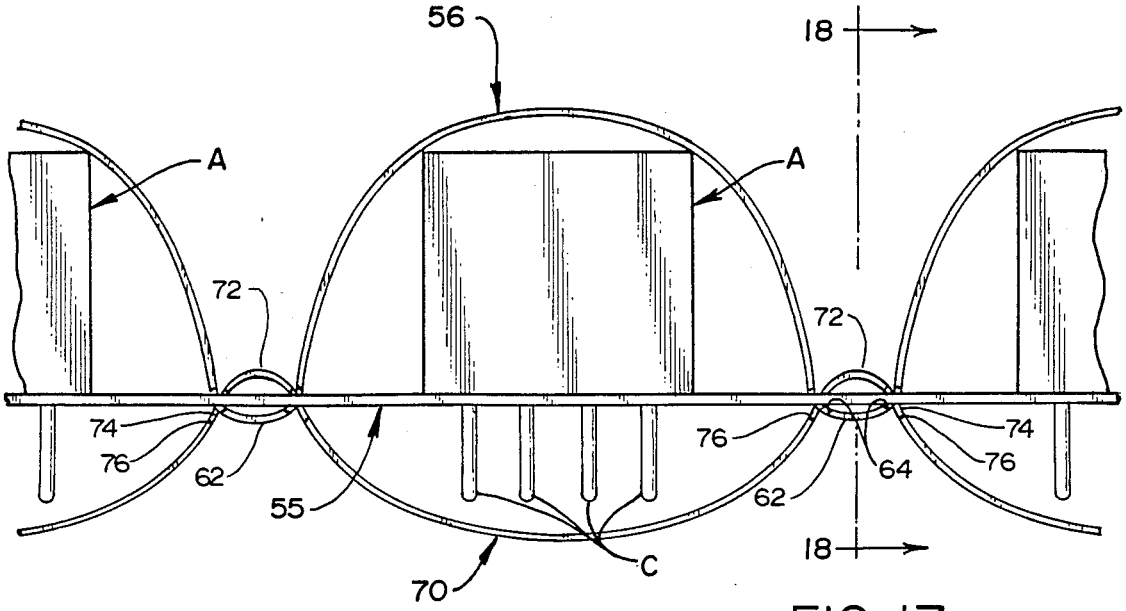
FIG. 17 is a side elevational view on an enlarged scale of a fragmentary portion of the packaging system shown in FIG. 14.

An alternative form of the basic flat loop packaging system is shown in FIGS. 11–13. This alternate configuration includes a carrier tape 40 and a bonding tape 41 that are also adapted to mechanically interlock into assembled relationship to form a packaging system for a plurality of articles A. The carrier tape 40 is provided with a grid-type locating means 42 comprising a plurality of apertures 43 for the articles A to be positioned thereon in longitudinally spaced relationship. Index apertures 44 are also provided in the marginal edge portions of the carrier tape in transverse alignment with attachment points 45 for the bonding tape and in predetermined relationship to the locating means 42. Attachment points 45 for the bonding tape are provided in the carrier tape intermediate each adjacent pair of articles. These attachment points comprise a rectangular aperture 46 having opposed end edges 47 interconnected by transversely extending side edges 48. Pairs of notches 49 are formed in the carrier tape at each end of an aperture 46 with each pair of notches cooperatively defining an interlocking tab 50. The transverse dimension between the opposed end edges 47 is less than the width of the bonding tape 41, but the distance between the outermost ends of an opposed pair of notches 49 is slightly greater than the width of the bonding tape.

Assembly of the bonding tape 41 with the carrier tape 40 is effected in substantially the same manner described with respect to the other embodiments. An insertion tool is pushed against the bonding tape 41 to form a loop with the pin thereof inserted in a circular aperture 51 formed in the bonding tape at the point where it is desired to form the loop. This loop is then forcibly projected into an aperture 46 with either the interlocking tab 50 or marginal edge portions of the bonding tape 41, or both, flexing to permit projection of the loop through the aperture. When the loop has been projected through the aperture to a sufficient extent, the interlocking tab 50 will return to a position overlying the bonding tape, or the marginal edge portions of the bonding tape will return to a position underlying the tab with the carrier and bonding tapes 40, 41 then being mechanically interlocked into assembled relationship. While the bonding tape 31 in the FIGS. 7–10 embodiment is locked against longitudinal displacement with respect to the carrier tape 30, such is not the case with the FIG. 11–13 embodiment. The bonding tape 41 may be pulled longitudinally into tightly conforming relationship to the articles with the bonding tape secured to the carrier tape at terminal ends of a length of the assembled tape (securing not shown).

A further modified packaging system embodying this invention is shown in FIGS. 14–18. This embodiment of the invention includes a carrier tape 55 and a bonding tape 56 which are also designed to be mechanically interlocked at attachment points 57 into assembled relationship to retain articles A on the carrier tape. The carrier tape 55 is provided with locating means 58 at longitudinally spaced points for positioning of the articles A in fixed relationship with respect to the carrier tape. Indexing apertures 59 may also be formed in the carrier tape 55 along marginal edge portions of the tape and in predetermined relationship to the article locating means 58. In this embodiment, more than two indexing apertures are formed in transversely aligned relationship at each attachment point 57 for engaging with a similar plurality of sprockets or other indexing means for the previously stated reasons.

In this embodiment, a plurality of apertures 60 of rectangular shape are provided at each attachment point. Three such apertures are formed in the carrier tape 55 in transversely aligned relationship with the two outermost apertures adapted to cooperatively interengage with the bonding tape 56. Formed in the bonding tape 56 at each point where a loop is to be formed for projection into the apertures 60 is a transversely extending, rectangularly shaped clearance aperture 61 resulting in formation of two relatively narrow webs 62 as can be best seen in FIG. 15. Each of these webs is of a longitudinal length that is sufficient to enable formation of a loop of appropriate size for projection into an aperture 60. The transverse width of these webs is greater than the spacing between end edges 63 of an aperture such that with the formation of pairs of notches 64 in the outer marginal edge portion of the bonding tape and at the end edge 65 of the clearance aperture 61, each of the webs can be projected into a respective aperture 60 and become mechanically interlocked with the carrier tape 55. Projection of the webs 62 through the apertures is effective in the same manner as previously described and is facilitated by providing a circular aperture 66 in the center of each web for engagement with a respective pin of an insertion tool advantageously having a corresponding plural number of the pins.

This construction of the carrier and bonding tape 55, 56 is advantageous for relatively wide tapes as it results in greater structural integrity than can be achieved by a single interlock. Use of a plurality of spaced apertures in the carrier tape enhances the stability of the assembly while maintaining the structural strength and rigidity of the tapes. The illustrative two aperture construction shown in FIGS. 14–18 can be expanded for relatively wider tapes by increasing the number of apertures formed in the carrier tape along with increasing the number of clearance apertures formed in the bonding tape. It is to be noted that the center aperture 60 need not be provided in the basic structure of this modification and the clearance aperture 61 could be formed as two relatively short apertures rather than as an elongated aperture. The specific structural configuration shown is designed for a further modification which will be subsequently explained. It will also be noted that the notches 64 need only be formed in either the outer marginal edge portion of the bonding tape or at the opposed end edges 65 of the clearance aperture 61 to effect mechanical interlocking. However, providing of the notches as shown results in a stronger lock.

For some articles, protection of connector pins C or other components that project through the carrier tape remains a critical factor. To provide a substantial degree of protection for such components, the packaging system shown in FIGS. 14–18 incorporates a further modification comprising a spacer tape 70. This spacer tape 70 is also fabricated from a strip of material that is resiliently flexible and is constructed to be secured to the carrier tape 55 through a mechanical interlock that is the same as that of the bonding tape 56. A fragmentary portion of the illustrative embodiment of the spacer tape shown in plan view in FIG. 16 and in FIGS. 17 and 18 as applied to the carrier tape has a width that is substantially equal to the transverse dimension of an article A referenced as positioned on the carrier tape and thus will provide protection for the entire bottom surface area of the article and any other elements thereof that may be projecting through the carrier tape. At longitudinally spaced points, attachment means 71 comprising relatively narrow connector webs 72 are formed. These webs are centrally aligned with the spacer tape 70 and have longitudinal side edges 73 spaced apart a distance that is greater than the spacing of the end edges 63 of the center aperture 60 of the set of three such apertures formed in the carrier tape. A pair of notches 74 are formed in each marginal side edge portion of the webs 72 and these notches are dimensioned to receive the carrier tape in edgewise relationship. The transverse dimension between the innermost ends of opposed pairs of notches 74 is less than the spacing of the end edges 63 of the aperture 60 and a loop may thus be formed in the web 72 and projected through the aperture and mechanically interlock with the carrier tape as can be best seen in FIG. 18. To facilitate projection of the loop into the aperture 60, a circular aperture 75 is formed in the center of the web 72 for engaging with the pin of an insertion tool. Longitudinal spacing of the notches 74 is advantageously of a dimension that will result in formation of a flat loop at the top of the carrier tape.

The size of the loop formed in the spacer tape 70 for extending over the articles' connector pins C is determined by the relative longitudinal spacing of the attachment means 71. It is desirable that this loop be sufficiently large so that the tape will be spaced from the connector pins. It is not necessary that the spacer tape be removed at the time articles are to be removed from the carrier tape. Since no complications will be encountered at the time of dispensing articles as a consequence of a tape removal operation, the spacer tape 70 may be formed from a more stiff material or be of a relatively greater thickness, thereby providing a greater degree of protection.

Figure 18:
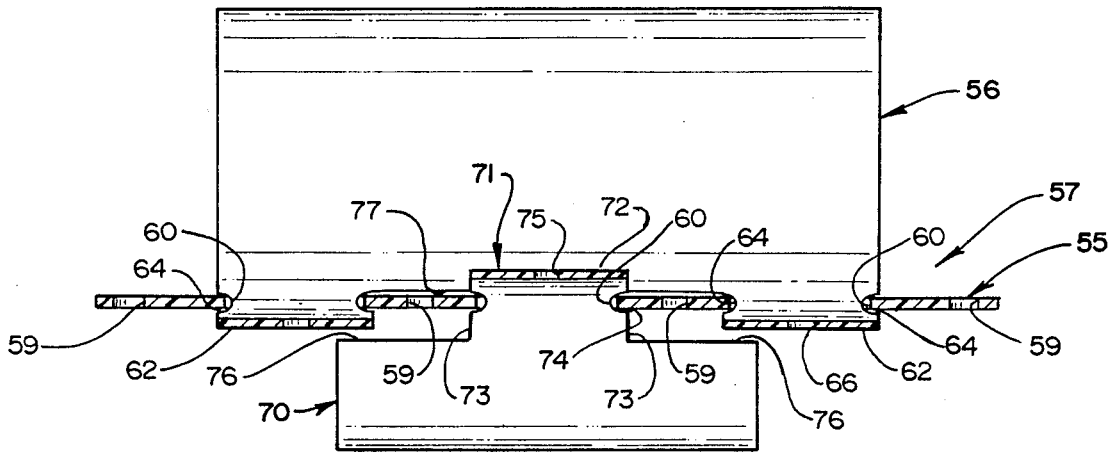
FIG. 18 is a sectional view taken along line 18—18 of FIG. 17 with FIG. 18A being a similar view of a modification.

Interference between the spacer tape 70 and the bonding tape 56 must be avoided when the bonding tape is either applied or removed. To prevent interference at the underside of the carrier tape 55, the longitudinal length of the connector webs 72 is made greater than the spacing of the notches 74. This can be best seen in FIG. 16 where the transverse edges 76 at opposite ends of the webs are spaced apart a distance to be beyond the notches. This results in those edges 76 being spaced a distance below the bottom surface of the carrier tape as can be seen in FIG. 18 and provide sufficient space for the loops of the bonding tape to be projected through the apertures 60 and to mechanically interlock with the carrier tape. The clearance aperture 61 formed in the bonding tape is formed with transversely extending edges 77 that are spaced apart a distance that is equal to the maximum longitudinal dimension of the notches 64.

Figure 18A:
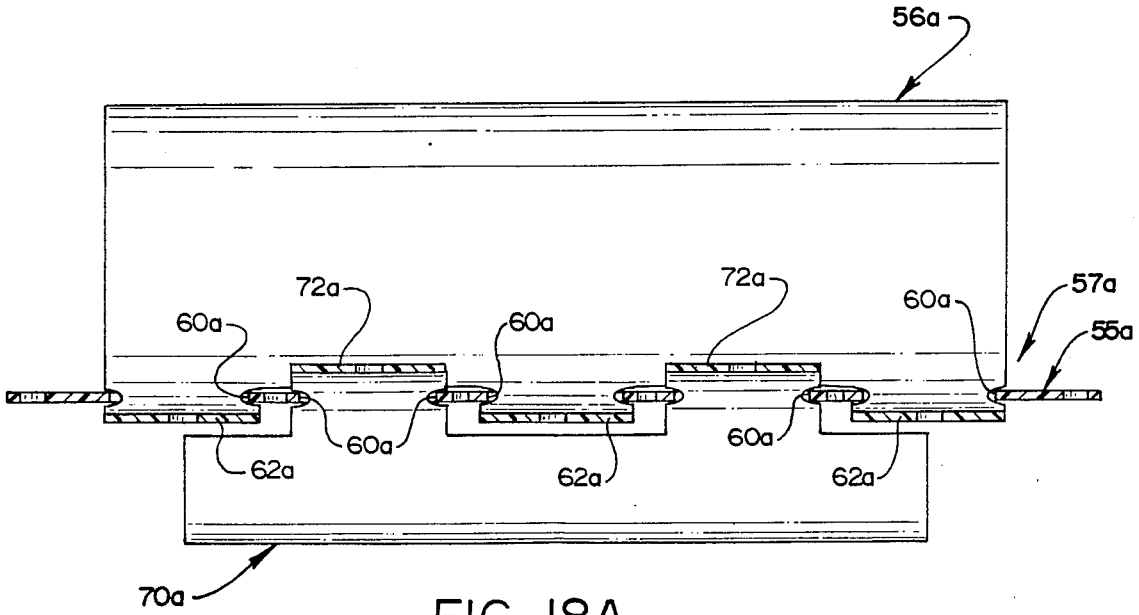

While the spacer tape shown in FIGS. 14–18 has only one web 72 for forming of a loop to be projected through a respective aperture 60, it is to be understood that the number of such webs may be increased similarly to the increase in numbers described with respect to the bonding tape 56. The specific number of webs in either of the bonding or spacing tapes is determined by the particular articles to be packaged. To illustrate this multiple arrangement, a dual web spacing tape structure is shown in FIG. 18A which shows the several tapes in cross-section at their point of interconnection. The carrier tape **55*a* is shown provided with five apertures 60*a* disposed in transversely spaced relationship across the tape at an attachment point 57*a*. The bonding tape 56*a* is formed with two clearance apertures 61*a* that are transversely spaced and results in formation of three webs 62*a*. The spacer tape 70*a* is formed with a clearance aperture 78 in the same manner and construction as previously shown with the bonding tape and thus a pair of webs 72*a* are formed. These webs 72*a* are projected through respective apertures 60*a* in alternating relationship to the webs 62*a*** to effect the mechanically interlocked interengagement. It will be readily apparent that the number of interconnecting webs, apertures and clearance apertures may be modified as necessary for the particular application of the package system. It will also be understood that the number of webs in each tape may be equal or that either tape may have a greater number of webs.

The articles A heretofore illustrated with the packaging system of this invention have for convenience been shown as being of a rectangular block configuration. An article of that configuration having a flat surface base of substantial area is stable when positioned on the carrier tape. However, there are articles of substantially different configurations that are also intended to be handled by the packaging system of this invention. Some of these articles are of a configuration having a relatively small base surface area as compared to their vertical extent and may not be satisfactorily stable when positioned on a carrier tape, particularly when it is recognized that the carrier tape is frequently advanced at a dispensing station with an intermittent, start and stop motion. Some of these articles also may not be provided with connector pins that are otherwise inserted into apertures of locating means to achieve greater stability.

Figure 19:
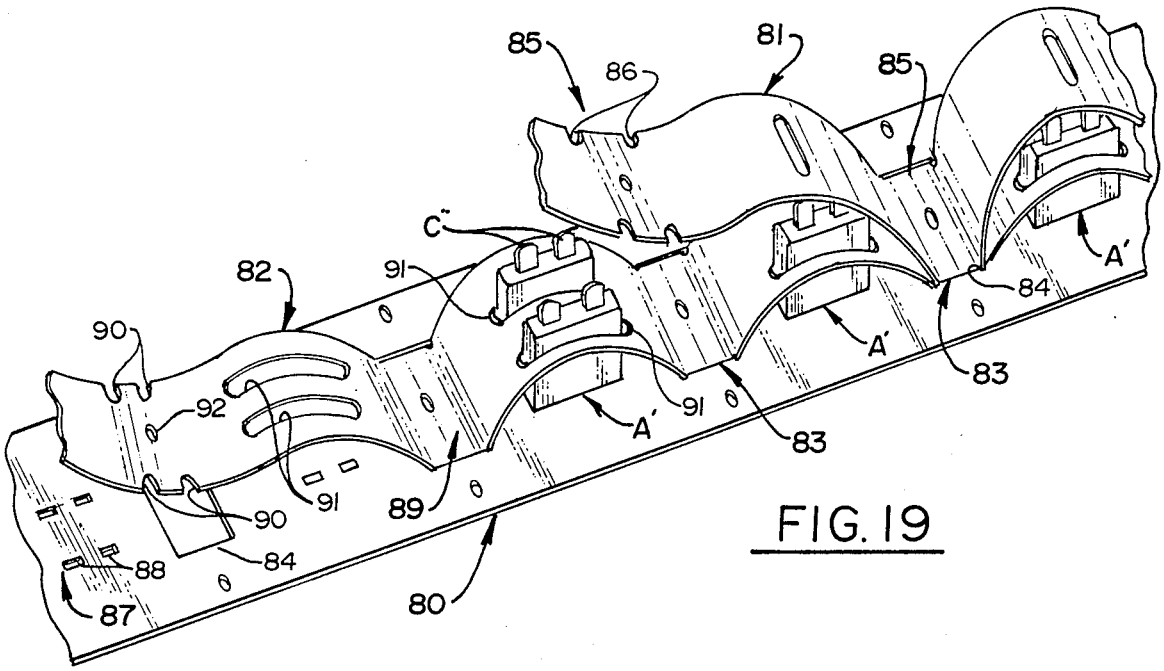
FIG. 19 is a perspective view of a fragmentary portion of another modified packaging system embodying this invention.
Figure 20:
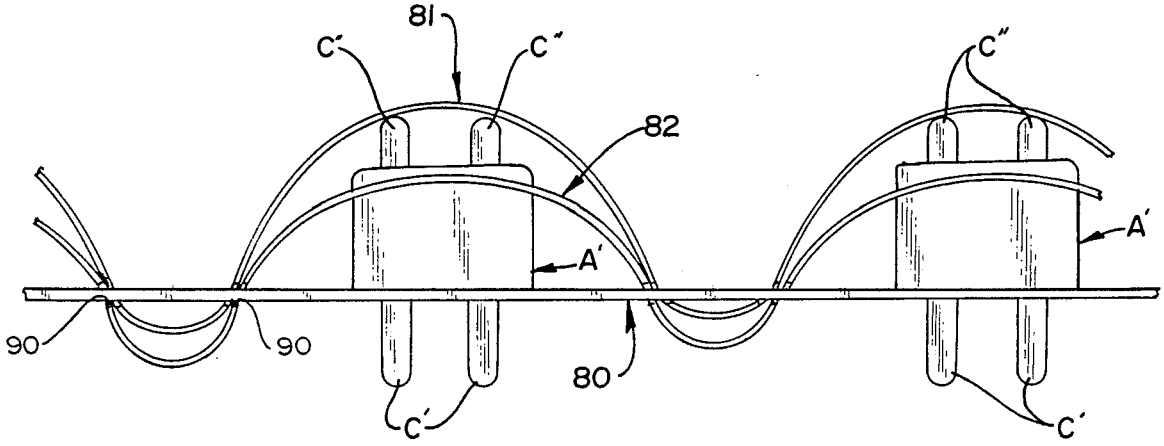
FIG. 20 is a side elevational view on an enlarged scale of a fragmentary portion of the packaging system shown in FIG. 19.
Figure 21:
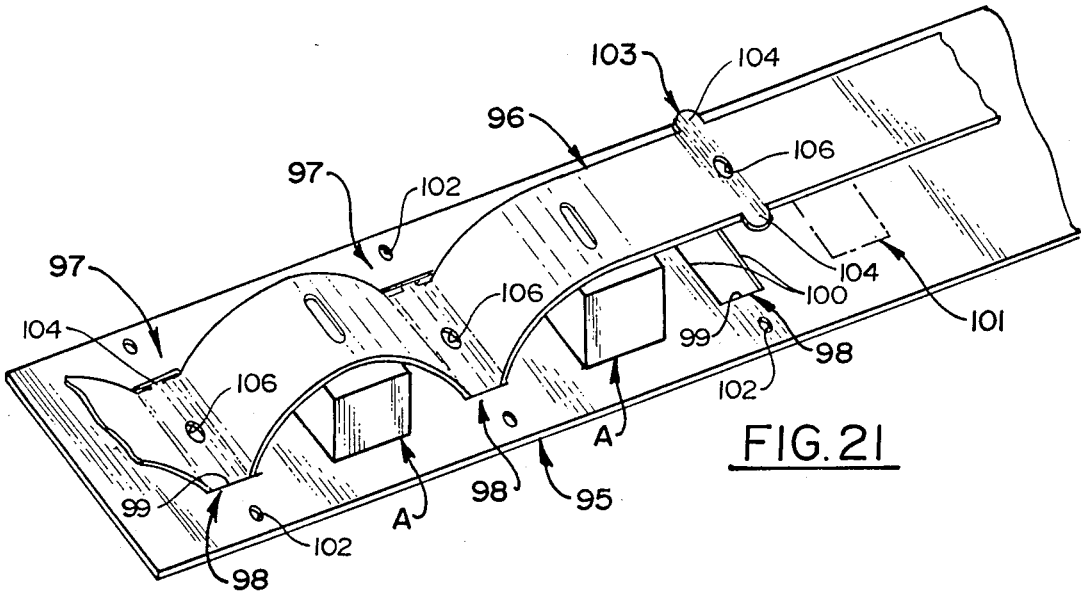
FIG. 21 is a perspective view of a fragmentary portion of another modified packaging system embodying this invention.
Figure 22:
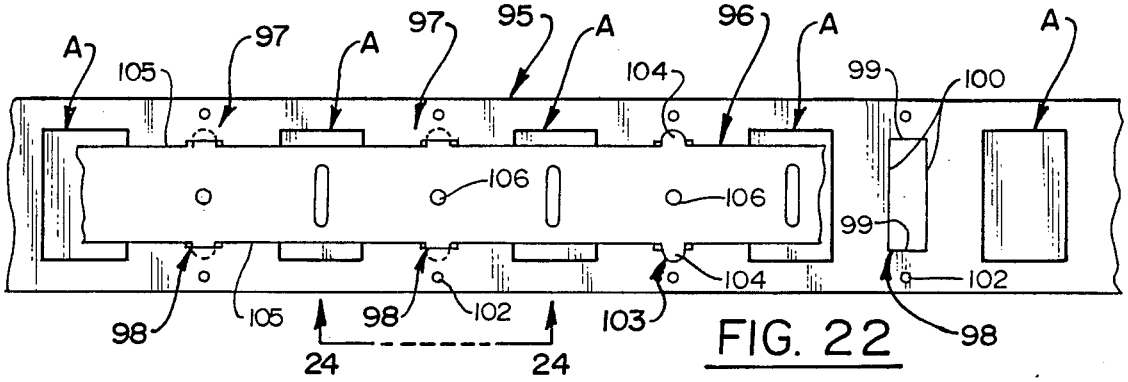
FIG. 22 is a top plan view on a reduced scale of a fragmentary portion of a packaging system as shown in FIG. 21.
Figure 23:
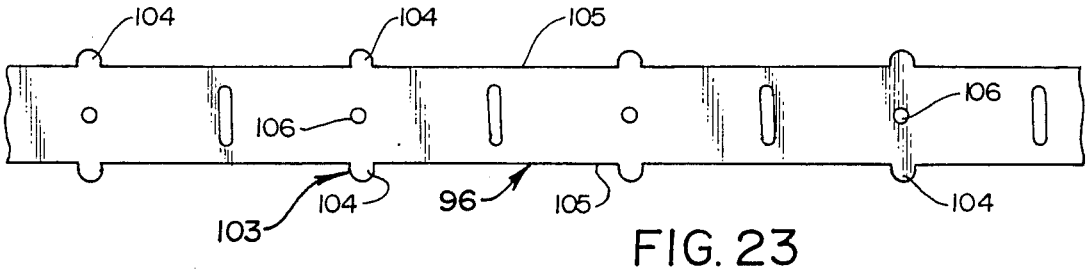
FIG. 23 is a plan view of the bonding tape shown in FIG. 22.
Figure 24:
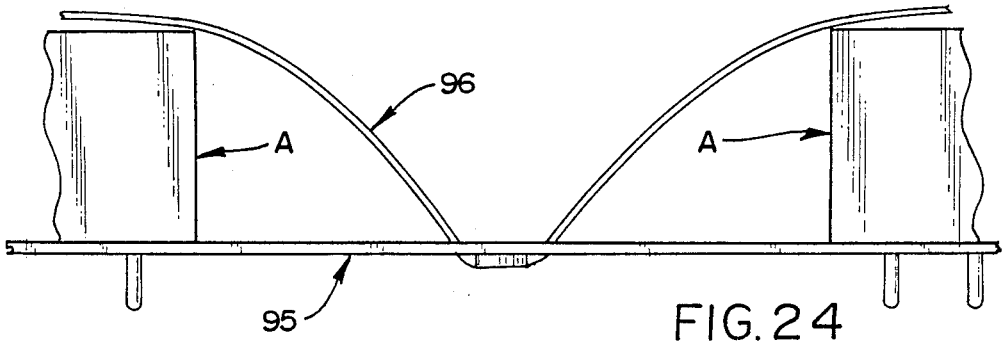
FIG. 24 is a side elevational view on an enlarged scale of the portion of the packaging system designated by the line 24—24 of FIG. 22.

To better accommodate articles that tend to be unstable, a modified packaging system is provided with an exemplary embodiment shown in FIGS. 19 and 20. This modified packaging system is illustrated with articles A′ that are shown as relatively narrow, elongated blocks which even with connecting pins C′ that project through the carrier tape, are very likely to tilt laterally from the required vertical orientation necessary for automated operations. This instability problem becomes of even greater consequence when the article either does not have pins C′ to project into the carrier tape or must be oriented on the carrier tape with connector pins C″ projecting upwardly. For purposes of illustration, the article A′ is shown as having pins C′ and C″ projecting in opposite direction, but a typical article would only have the one set of pins projecting in one direction. In addition to the basic carrier tape 80 and bonding tape 81, this modified system includes a locating tape 82 to provide the necessary stability for the article. The carrier tape 80 and the bonding tape 81 are substantially identical in structure to the embodiment of the packaging system shown in FIGS. 7–10 and further details of structure and function may be obtained from the related portion of this specification. In general, the carrier tape includes a plurality of longitudinally spaced attachment points 83 in the form of rectangular apertures 84 and the bonding tape includes a plurality of longitudinally spaced connecting means 85 in the form of a plurality of notches 86 formed in the longitudinal marginal edge portion of the bonding tape. In the case of use with an article having downwardly projecting pins C', locating means 87 are provided in the carrier tape to receive the connector pins C' with this locating means being shown as a pair of elongated, longitudinally aligned slots 88 through which the blade shaped pins project. If the article does not have downwardly projecting pins, then the carrier tape 80 is not formed with such locating means.

The locating tape 82 is formed from an elongated strip of resiliently flexible material and is formed with connecting means 89 at longitudinally spaced intervals to effect mechanical interengagement with the carrier tape in interlocked relationship. This connecting means 89 is identical to the connecting means 85 of the bonding tape and comprises a pair of longitudinally spaced notches 90 formed in the marginal edges of the locating tape 82. Formed in the locating tape intermediate adjacent connecting means 89 are a pair of elongated slots 91 that are of a dimension to receive the articles A'. This packaging system first has the locating tape 82 assembled with the carrier tape 80 in the same manner as the bonding tapes previously described and for that purpose, it has a circular aperture 92 at each point where a loop is to be formed for engaging with the pin of an insertion tool. Since the bonding tape has loops projected through the same apertures 84 as are loops of the locating tape, the notches 90 in the locating tape are longitudinally spaced a relatively greater distance than the notches 86 in the bonding tape, thereby forming a larger loop and resulting in a greater projection from the underside of the carrier tape. The locating tape loop is made sufficiently large so that after the locating tape is assembled with the carrier tape, the bonding tape may also be assembled by projecting a loop through the aperture. The connecting means 89 of the locating tape are spaced apart a distance which will result in that tape forming a loop above the carrier tape of lesser height than the articles A'. The articles may then be placed in the elongated slots 91 which will maintain them in an upright position and the bonding tape is then assembled to retain the articles in the package. At the time of use, it is only necessary to remove the bonding tape as the upper end portions of the articles A' will be exposed and can be picked up by the automatic handling apparatus. The locating tape 82 thus continues to locate or orient the articles from the time that the bonding tape is removed until the articles are removed.

The packaging systems hereinbefore specifically illustrated and described have utilized notches formed in the longitudinal marginal edge portions of the bonding tapes to effect a mechanical interlock with the carrier with the exception of the modified packaging system shown in FIGS. 11–13. The system of FIGS. 11–13 is in effect an inverse arrangement of the interlocking components as compared to the system of FIGS. 7–10, although it does have a slightly different function. A further modified packaging system embodying this invention is shown in FIGS. 21–24 and incorporates a construction that is in effect an inverse arrangement of the interlocking components as compared to either the system of FIGS. 7–10 or the system of FIGS. 11–13. The system of FIGS. 21–24 comprises a basic combination of a carrier tape 95 and a bonding tape 96 that are constructed to cooperatively effect a mechanical interlock of the tapes at longitudinally spaced intervals for retaining articles on the carrier tape. The carrier tape is provided with a plurality of longitudinally spaced attachment points 97 that each include a rectangularly shaped aperture 98 having transversely spaced, longitudinally extending end edges 99 interconnected by transversely extending side edges 100. Article locating means 101 is also provided at points intermediate the attachment points 97 with several typical articles A shown positioned on the carrier tape. Indexing apertures 102 are formed in the marginal edge portions of the carrier tape in predetermined relationship to each respective article locating means 101.

In this modification of the article packaging system shown in FIGS. 21–24, the bonding tape 96 is provided with a plurality of connecting means 103 comprising projections 104 extending a distance laterally outward from the longitudinal side edges 105 of the bonding tape. These projections 104 are disposed in pairs at longitudinally spaced intervals along the bonding tape with the projection pairs being diametrically disposed. The bonding tape has a width dimension with respect to its side edges 105 that is slightly less than the transverse spacing of the end edges 99 of the apertures 97 in the carrier tape so that a loop of the bonding tape may be projected through the aperture. The pairs of projections 104 thus have a transverse dimension with respect to their outermost ends that is greater than the transverse spacing of the apertures' end edges 98. When the tapes 95, 96 are assembled, these projections 104 extend in overlapped relationship to the bottom surface of the carrier tape 95 to form a mechanical interlock. Insertion of a loop of the bonding tape through an aperture 98 by means of an insertion tool such as that illustrated and described is facilitated by forming of circular apertures 106 at the center of the bonding tape between a pair of projections 104. As a loop of the bonding tape is projected through the carrier tape aperture 98, the projections 104 of the bonding tape which is formed from a resiliently flexible material will initially be bent or flexed to permit passage through the aperture and after passage, will return to their original position to effect the mechanical interlock.

Figure 25:
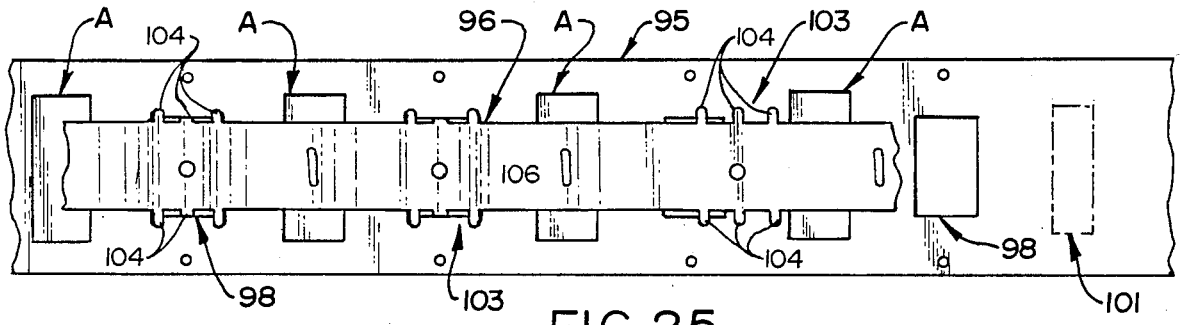
FIG. 25 is a top plan view of a fragmentary portion of a variant of the packaging system shown in FIGS. 21-24.
Figure 26:
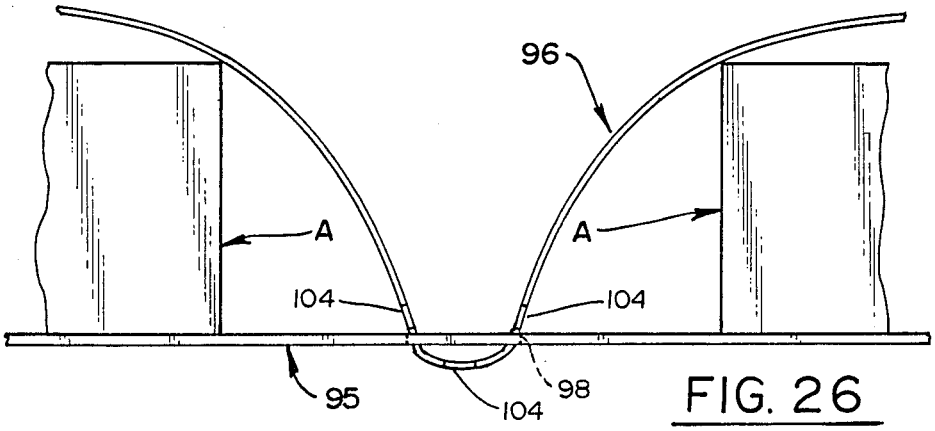
FIG. 26 is a side elevational view on an enlarged scale of the variant shown in FIG. 25.

A variation of the projection-type modification (FIGS. 21–24) is shown in FIGS. 25 and 26. This variation comprises formation of sets of three projections 104 on each side of the bonding tape 96. In assembly of the bonding tape 96 with a carrier tape 95, only the center projection is projected with a loop of the bonding tape through a respective aperture 98. The other two projections remain above the carrier tape in overlying relationship to its upper surface. This structural variation results in a mechanical interlock that effectively fixes the bonding tape against movement through the aperture once the tapes have been assembled where the bonding tape is formed with a "flat loop".

Figure 27:
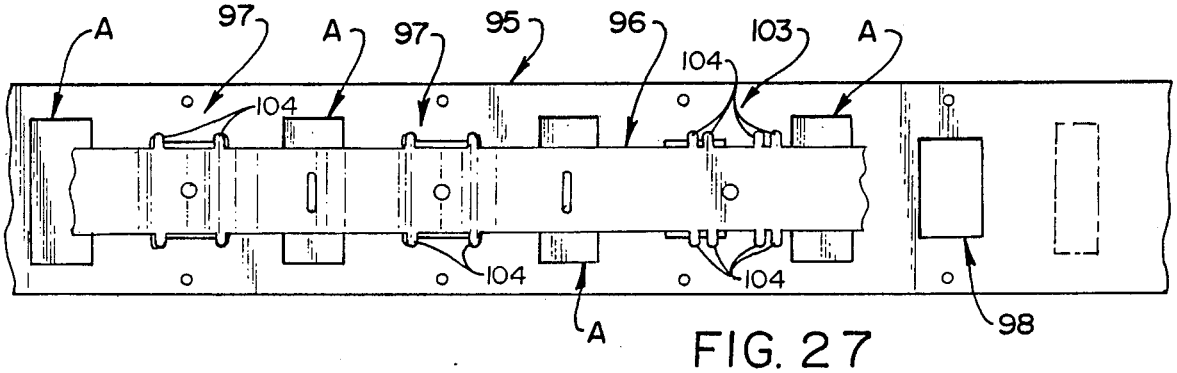
FIG. 27 is a top plan view of a fragmentary portion of another variant of the packaging system shown in FIGS. 21-24.
Figure 28:
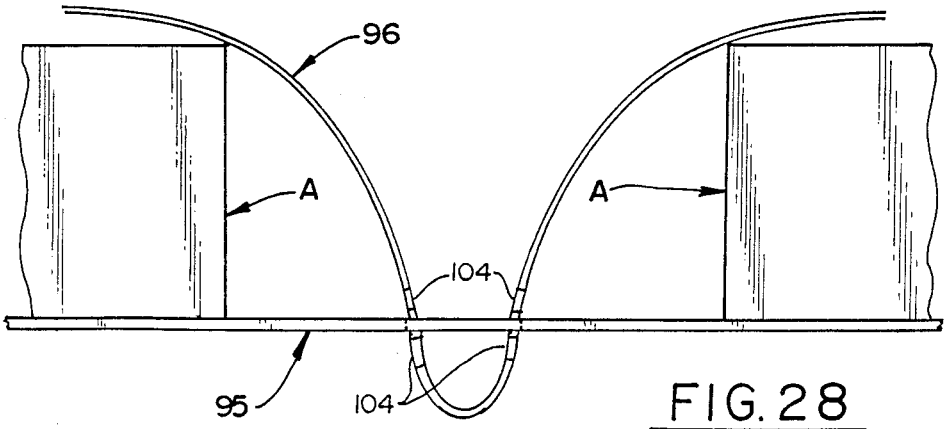
FIG. 28 is a side elevational view on an enlarged scale of the variant shown in FIG. 27.

A further variation of the projection-type modification (FIGS. 21–24) is shown in FIGS. 27 and 28. This variation comprises formation of four projections 104 on each side of the bonding tape 96. The four projections on each side are arranged in pairs of projections that are relatively closely spaced with the pairs being spaced apart a relatively greater distance. The projections in each pair are spaced a distance apart that is sufficient to enable projection of the one through the aperture 98, whereby the carrier tape will be received in edgewise relationship between the two projections and the bonding tape will be effectively fixed against movement with respect to the carrier tape as is necessary to form a large loop of the bonding tape on the bottom of the carrier tape to perform a spacing function. The relative spacing of the pairs of projections thus determines the size of the loop formed on the bottom of the carrier tape.

Figure 29:
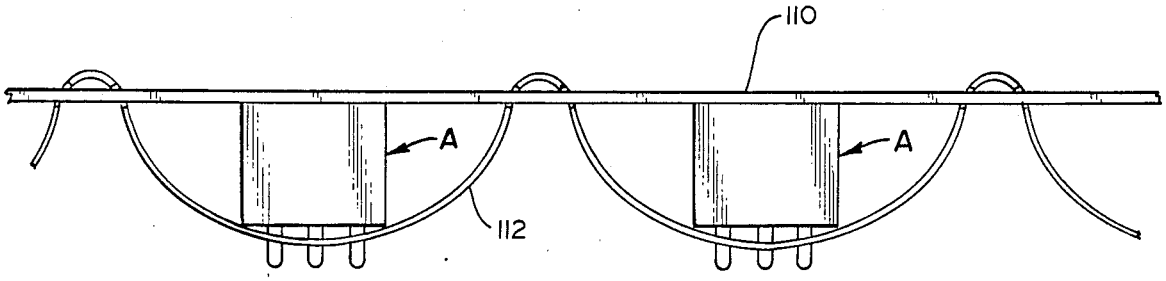
FIG. 29 is a side elevational view of a fragmentary portion of a modified packaging system embodying this invention.
Figure 30:
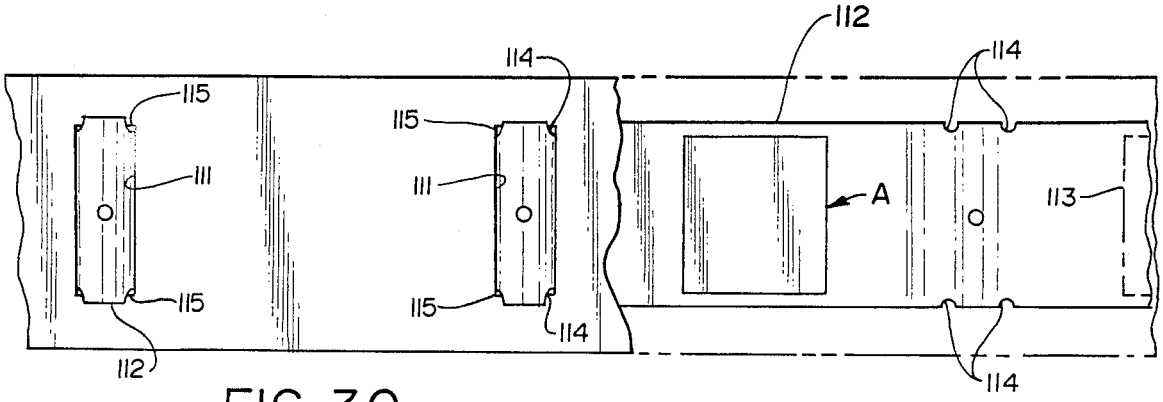
FIG. 30 is a top plan view of the packaging system shown in FIG. 29.

Each of the embodiments of the packaging system of this invention illustrated and described herein have been described as having the carrier tape remaining flat and the bonding tape being formed in loops to extend over the articles. This relationship may be reversed as is shown by the modification in FIGS. 29 and.30. In that modification, the bonding tape 110 is formed with a plurality of longitudinally spaced apertures 111 defining attachment points for the carrier tape 112. The carrier tape is formed with article locating means 113 at longitudinally spaced points with the locating means being adapted to cooperatively engage with the specific articles A. Mechanically interlocked engagement of the tapes is effected by formation of pairs of notches 114 in each marginal edge portion of the carrier tape 112 at points intermediate the article locating means. The carrier tape has a transverse dimension at the location of the nothces 114 that is greater than the transverse spacing of the end edges 115 of the aperture while the spacing between the innermost ends of the notches is less than the spacing of the aperture's end edges. Forming the carrier tape into loops at the locations of the pairs of notches 114 and projecting the loop through a respective aperture 111 results in the notches receiving the bonding tape in edgewise relationship and becoming interlocked.

Other specific embodiments of a packaging system may be provided in accordance with this invention. For example, locating means for the articles other than the multiple aperture type shown in the drawings may be incorporated into a particular packaging system. Alternative article locating means are shown in application Ser. No. 652,579.

It will be readily apparent from the foregoing description of the several illustrative embodiments of this invention that a novel packaging system has been provided for enabling the automation of manufacturing or component assembly processes and systems. Providing of a secure mechanical interlock greatly enhances utilization of the packaging system through minimization of the likelihood of inadvertent disconnection of the tapes. Including in the basic combination of a carrier and a bonding tape either a spacer tape or a locating tape results in greater versatility of the packaging system for packaging of widely diverse types of articles. Providing of multiple point interconnection of the tapes further adds to the versatility of the packaging system.

Having thus described this invention, what is claimed is:

1. An article packaging system for a plurality of articles disposed seriatim in predetermined relationship including a primary package comprising (A) a carrier tape of elongated, flat strip form having a plurality of article locating means disposed seriatim along a longitudinal axis of said tape in spaced relationship on a surface thereof, each of said article locating means adapted to cooperatively engage with at least one article to releasably position that article in a predetermined location and orientation with respect to said tape, (B) article bonding means for maintaining articles on said carrier tape in association with respective article locating means, said bonding means including an article bonding tape of elongated, flat strip form disposed in longitudinally extending relationship to said carrier tape and overlying articles positioned in engagement with respective ones of said article locating means, and (C) interengaging means for releasably interconnecting said bonding tape with said carrier tape at selected points spaced longitudinally of said carrier tape at opposite sides of said article locating means whereby articles positioned in engagement with respective article locating means will be retained in packaged relationship, said interengaging means including a plurality of apertures formed in one of said carrier and bonding tapes with one of said plurality of apertures formed at each of said selected points, each of said plurality of apertures being of a transverse dimension with respect to the longitudinal axis of the tape in which it is formed to enable projection therethrough of a loop of the other of said tapes, the transverse width of at least a portion of that part of the tape projecting through any one of said plurality of apertures being greater than a minimum transverse dimension of said aperture through which it is projected to thereby form a mechanical interlock between said tapes, at least one of said tapes being resiliently deformable to enable formation of a loop therein and releasable interconnection of said tapes.

2. An article packaging system according to claim 1 wherein said apertures are formed in said carrier tape.

3. An article packaging system according to claim 1 wherein said apertures are formed in said bonding tape.

4. An article packaging system according to claim 1 wherein at least the loop portion of said tape projecting through any one of said plurality of apertures has longitudinally extending side edges transversely spaced apart a distance greater than the transverse dimension of said aperture through which it is projected and is formed with a pair of notches in each longitudinal marginal edge portion of each location where it is to be projected through one of said plurality of apertures, said notches opening at the respective side edge and of a size to receive the other tape in edgewise relationship.

5. An article packaging system according to claim 4 wherein each of the pair of said notches is transversely aligned with a respective notch of the other pair and the transverse distance between the innermost ends of an opposed pair of notches is less than the transverse dimension of said apertures.

6. An article packaging system according to claim 5 wherein the notches in each pair are longitudinally spaced a predetermined distance apart in the marginal edge portion of the tape, the portion of the tape intermediate each pair of notches being formable into a loop about an axis lying in the plane of the tape and disposed transversely to the longitudinal axis thereof.

7. An article packaging system according to claim 6 wherein the loop formed in the one tape projects a predetermined distance from the other tape to support the other tape in spaced relationship to a structure against which it is disposed.

8. An article packaging system according to claim 1 wherein each of said apertures is formed with transversely spaced end edges that are spaced apart a distance greater than the transverse width of a tape to be projected therethrough, said apertures having a locking tab projecting a distance transversely inward of each respective end edge to extend over at least a marginal edge portion of the tape projected therethrough.

9. An article packaging system according to claim 1 wherein each of said apertures is formed with spaced marginal end edge portions each having a pair of notches formed therein and opening to the aperture, said notches being of a longitudinal dimension to receive a marginal edge portion of the other tape in edgewise relationship, each pair of notches being longitudinally spaced a distance to cooperatively define a locking tab projecting relatively inward of the aperture and extend over a marginal edge portion of the tape projected through the aperture.

10. An article packaging system according to claim 1 which includes a locating tape of elongated, flat strip form disposed in longitudinally extending relationship to each of said carrier and bonding tapes, said apertures being formed either in said carrier tape or in said bonding and locating tapes, said locating tape having a portion thereof extending over the locating means of said carrier tape in relatively spaced relationship thereto and aperture means for cooperatively engaging with an article positioned on said carrier tape for maintaining the article in a predetermined orientation with respect to said carrier tape.

11. An article packaging system according to claim 10 wherein said locating tape portion extending over said article locating means is spaced from said bonding tape.

12. An article packaging system according to claim 1 which includes a spacer tape of elongated, flat strip form disposed in longitudinally extending relationship to said carrier tape at the side thereof opposite said bonding tape, said carrier tape having at least three of said apertures formed therein at each of said selected points and disposed in transversely aligned relationship, said bonding tape having a clearance aperture formed therein at each point where the bonding tape is to interconnect with said carrier tape to thereby define two webs that are transversely spaced for projection through respective ones of said apertures, said spacer tape adapted to be projected through the other of said apertures into interlocked relationship.

13. An article packaging system according to claim 1 wehrein said interengaging means includes a plurality of apertures formed in one of said carrier and bonding tapes in transversely aligned and relatively spaced relationship, the other of said tapes having at least one aperture formed therein and thereby defining two webs transversely spaced a distance to each align with a respective aperture, each web adapted to project through a respective aperture.

14. An article packaging system according to claim 1 wherein said tape projecting through an aperture has longitudinally extending side edges transversely spaced apart a distance less than the transverse dimension of said apertures and is formed with a projection on each respective side edge in transversely opposed relationship, said projections extending a distance laterally outward therefrom to overlie the other tape.

15. An article packaging system according to claim 14 wherein said tape projecting through an aperture has three projections formed on each respective side edge, each of said projections being transversely aligned with a projection on the opposite side edge with adjacent projections on a side edge being longitudinally spaced apart a distance to receive the other tape therebetween in edgewise relationship.

16. An article packaging system according to claim 14 wherein said tape projecting through an aperture has four projections formed on each respective side edge, each of said projections being transversely aligned with a projection on the opposite side edge, said projections being disposed in pairs that are longitudinally spaced a predetermined distance apart, the projections in each pair being longitudinally spaced apart a distance to receive the other tape therebetween in edgewise relationship.

* * * * *